US008646779B2

(12) United States Patent
Grauzer et al.

(10) Patent No.: US 8,646,779 B2
(45) **Date of Patent: *Feb. 11, 2014**

(54) DEVICE AND METHOD FOR HANDLING, SHUFFLING, AND MOVING CARDS

(75) Inventors: Attila Grauzer, Las Vegas, NV (US); Robert J. Rynda, Henderson, NV (US); Ronald R. Swanson, Otsego, MN (US)

(73) Assignee: SHFL Entertainment, Inc., Las Vegas, NV (US)

( * ) Notice: Subject to any disclaimer, the term of this patent is extended or adjusted under 35 U.S.C. 154(b) by 8 days.

This patent is subject to a terminal disclaimer.

(21) Appl. No.: 13/540,234

(22) Filed: Jul. 2, 2012

(65) Prior Publication Data

US 2012/0286471 A1 Nov. 15, 2012

Related U.S. Application Data

(60) Continuation of application No. 12/871,594, filed on Aug. 30, 2010, now Pat. No. 8,210,535, which is a continuation of application No. 12/011,438, filed on Jan. 25, 2008, now Pat. No. 7,784,790, which is a division of application No. 10/977,993, filed on Oct. 29, 2004, now Pat. No. 7,322,576, which is a continuation of application No. 10/286,985, filed on Oct. 31, 2002, now abandoned, which is a continuation of application No. 09/690,051, filed on Oct. 16, 2000, now Pat. No. 6,588,751, which is a continuation-in-part of application No. 09/060,598, filed on Apr. 15, 1998, now Pat. No. 6,254,096.

(51) Int. Cl.
*A63F 1/12* (2006.01)

(52) U.S. Cl.
USPC ..... 273/149 R; 273/149 P

(58) Field of Classification Search
USPC ..... 273/149 R, 149 P
See application file for complete search history.

(56) References Cited

U.S. PATENT DOCUMENTS 205,030 A 6/1878 Ash
609,730 A 8/1898 Booth (Continued)

FOREIGN PATENT DOCUMENTS

CA 2266555 9/1996
DE 67 26 16 11/1949

(Continued)

OTHER PUBLICATIONS

Specification of Australian Patent Application No. 31577/95, filed Jan. 17, 1995, Applicants: Rodney G. Johnson et al., Title: Card Handling Apparatus.

(Continued)

*Primary Examiner* — Benjamin Layno
(74) *Attorney, Agent, or Firm* — TraskBritt

(57) ABSTRACT

Card-handling devices include a card-holding area and a card output shoe. The card output shoe includes a card-way for passage of cards from the card-holding area into a dealing-ready area. A movable gate is positioned between the card-way and the dealing-ready area to prevent cards in the dealing-ready area from re-entering the card-way. Card shufflers include a gate mounted to allow movement of randomized groups of cards from card-receiving compartments to proximate a terminal end plate of a card output shoe and to block movement of cards in an opposite direction. In related methods of moving cards, card movement through the card-way to the dealing-ready position is allowed by a movable gate and card movement from the dealing-ready position into the card-way is prevented by the movable gate.

19 Claims, 14 Drawing Sheets

(56) References Cited

U.S. PATENT DOCUMENTS

| | | | |
|---|---|---|---|
| 673,154 | A | 4/1901 | Bellows |
| 793,489 | A | 6/1905 | Williams |
| 1,014,219 | A | 1/1912 | Hall |
| 1,043,109 | A | 11/1912 | Hurm |
| 1,157,898 | A | 10/1915 | Pekret |
| 1,850,114 | A | 3/1932 | McCaddin |
| 1,955,926 | A | 4/1934 | Matthaey |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,065,824 | A | 12/1936 | Plass |
| 2,328,153 | A | 8/1943 | Laing |
| 2,328,879 | A | 9/1943 | Isaacson |
| 2,525,305 | A | 10/1950 | Lombard |
| 2,717,782 | A | 9/1955 | Droll |
| 2,778,644 | A | 1/1957 | Stephenson |
| 2,914,215 | A | 11/1959 | Neidig |
| 2,937,739 | A | 5/1960 | Levy |
| 2,950,005 | A | 8/1960 | MacDonald |
| 3,107,096 | A | 10/1963 | Osborn |
| 3,147,978 | A | 9/1964 | Sjostrand |
| 3,235,741 | A | 2/1966 | Plaisance |
| 3,312,473 | A | 4/1967 | Friedman et al. |
| 3,588,116 | A | 6/1971 | Miura |
| 3,589,730 | A | 6/1971 | Slay |
| 3,690,670 | A | 9/1972 | Cassady |
| 3,716,238 | A | 2/1973 | Porter |
| 3,897,954 | A | 8/1975 | Erickson |
| 3,944,077 | A | 3/1976 | Green |
| 3,944,230 | A | 3/1976 | Fineman |
| 4,159,581 | A | 7/1979 | Lichtenberg |
| 4,232,861 | A | 11/1980 | Maul |
| 4,361,393 | A | 11/1982 | Noto |
| 4,368,972 | A | 1/1983 | Naramore |
| 4,385,827 | A | 5/1983 | Naramore |
| 4,397,469 | A | 8/1983 | Carter |
| 4,497,488 | A | 2/1985 | Plevyak et al. |
| 4,513,969 | A | 4/1985 | Samsel |
| 4,515,367 | A | 5/1985 | Howard |
| 4,534,562 | A | 8/1985 | Cuff et al. |
| 4,566,782 | A | 1/1986 | Britt et al. |
| 4,586,712 | A | 5/1986 | Lorber et al. |
| 4,659,082 | A | 4/1987 | Greenberg |
| 4,667,959 | A | 5/1987 | Pfeiffer et al. |
| 4,741,524 | A | 5/1988 | Bromage |
| 4,750,743 | A | 6/1988 | Nicoletti |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak |
| 4,900,009 | A | 2/1990 | Kitahara et al. |
| 4,969,648 | A | 11/1990 | Hollinger et al. |
| 5,000,453 | A | 3/1991 | Stevens et al. |
| 5,067,713 | A | 11/1991 | Soules et al. |
| 5,096,197 | A | 3/1992 | Embury |
| 5,121,921 | A | 6/1992 | Friedman |
| 5,199,710 | A | 4/1993 | Lamle |
| 5,240,140 | A | 8/1993 | Huen |
| 5,261,667 | A | 11/1993 | Breeding |
| 5,275,411 | A | 1/1994 | Breeding |
| 5,288,081 | A | 2/1994 | Breeding et al. |
| 5,303,921 | A | 4/1994 | Breeding |
| 5,344,146 | A | 9/1994 | Lee |
| 5,356,145 | A | 10/1994 | Verschoor |
| 5,374,061 | A | 12/1994 | Albrecht et al. |
| 5,382,024 | A | 1/1995 | Blaha |
| 5,382,025 | A | 1/1995 | Sklansky et al. |
| 5,390,910 | A | 2/1995 | Mandel |
| 5,431,399 | A | 7/1995 | Kelley et al. |
| 5,437,462 | A | 8/1995 | Breeding |
| 5,584,483 | A | 12/1996 | Sines et al. |
| 5,586,936 | A | 12/1996 | Bennett et al. |
| 5,605,334 | A | 2/1997 | McCrea et al. |
| 5,669,816 | A | 9/1997 | Garczynski et al. |
| 5,676,372 | A | 10/1997 | Sines et al. |
| 5,681,039 | A | 10/1997 | Miller et al. |
| 5,683,085 | A | 11/1997 | Johnson et al. |
| 5,690,324 | A | 11/1997 | Otomo et al. |
| 5,692,748 | A | 12/1997 | Frisco et al. |
| 5,695,189 | A | 12/1997 | Breeding et al. |
| 5,707,287 | A | 1/1998 | McCrea et al. |
| 5,718,427 | A | 2/1998 | Cranford et al. |
| 5,722,893 | A | 3/1998 | Hill et al. |
| 5,772,505 | A | 6/1998 | Garczynski et al. |
| 5,779,546 | A | 7/1998 | Meissner et al. |
| 5,803,808 | A | 9/1998 | Strisower et al. |
| 5,941,769 | A | 8/1999 | Order et al. |
| 5,944,310 | A | 8/1999 | Johnson et al. |
| 5,989,122 | A | 11/1999 | Roblejo et al. |
| 6,019,368 | A | 2/2000 | Sines et al. |
| 6,039,650 | A | 3/2000 | Hill et al. |
| 6,068,258 | A | 5/2000 | Breeding et al. |
| 6,093,103 | A | 7/2000 | McCrea et al. |
| 6,117,012 | A | 9/2000 | McCrea et al. |
| 6,126,166 | A | 10/2000 | Lorson et al. |
| 6,139,014 | A | 10/2000 | Breeding et al. |
| 6,149,154 | A | 11/2000 | Grauzer et al. |
| 6,165,069 | A | 12/2000 | Sines et al. |
| 6,165,072 | A | 12/2000 | Davis et al. |
| 6,217,447 | B1 | 4/2001 | Lofink et al. |
| 6,250,632 | B1 | 6/2001 | Albrecht |
| 6,254,096 | B1 | 7/2001 | Grauzer et al. |
| 6,254,484 | B1 | 7/2001 | McCrea, Jr. |
| 6,267,248 | B1 | 7/2001 | Johnson et al. |
| 6,270,404 | B2 | 8/2001 | Sines et al. |
| 6,299,536 | B1 | 10/2001 | Hill |
| 6,325,373 | B1 | 12/2001 | Breeding et al. |
| 6,346,044 | B1 | 2/2002 | McCrea, Jr. |
| 6,361,044 | B1 | 3/2002 | Block et al. |
| 6,403,908 | B2 | 6/2002 | Stardust et al. |
| 6,568,678 | B2 | 5/2003 | Breeding et al. |
| 6,588,750 | B1 | 7/2003 | Grauzer et al. |
| 6,588,751 | B1 | 7/2003 | Grauzer et al. |
| 6,651,981 | B2 | 11/2003 | Grauzer et al. |
| 6,651,982 | B2 | 11/2003 | Grauzer et al. |
| 6,655,684 | B2 | 12/2003 | Grauzer et al. |
| 6,659,460 | B2 | 12/2003 | Blaha et al. |
| 6,676,127 | B2 | 1/2004 | Johnson et al. |
| 6,732,067 | B1 | 5/2004 | Powderly |
| 7,059,602 | B2 | 6/2006 | Grauzer et al. |
| 7,066,464 | B2 | 6/2006 | Blad et al. |
| 7,073,791 | B2 | 7/2006 | Grauzer et al. |
| 7,234,698 | B2 | 6/2007 | Grauzer et al. |
| 7,523,936 | B2 | 4/2009 | Grauzer et al. |
| 7,584,962 | B2 | 9/2009 | Breeding et al. |
| 7,584,963 | B2 | 9/2009 | Krenn et al. |
| 7,677,566 | B2 | 3/2010 | Krenn et al. |
| 7,967,294 | B2 * | 6/2011 | Blaha et al. ..... 273/149 R |
| 2002/0163125 | A1 | 11/2002 | Grauzer et al. |
| 2003/0007143 | A1 | 1/2003 | McArthur et al. |

FOREIGN PATENT DOCUMENTS

| | | |
|---|---|---|
| WO | 98/40136 | 9/1998 |
| WO | 00/51076 | 8/2000 |

OTHER PUBLICATIONS

Specification of Australian Patent Application No. Not Listed, filed Aug. 15, 1994, Applicants: Rodney G. Johnson et al., Title: Card Handling Apparatus.

Encyclopedia of Games by John Scarne, 1973, "Super Contract Bridge," p. 153.

* cited by examiner

DEVICE AND METHOD FOR HANDLING, SHUFFLING, AND MOVING CARDS

CROSS-REFERENCE TO RELATED APPLICATIONS

This application is a continuation of U.S. patent application Ser. No. 12/871,594, filed Aug. 30, 2010, now U.S. Pat. No. 8,210,535, issued Jul. 3, 2012, which is a continuation of U.S. patent application Ser. No. 12/011,438, filed Jan. 25, 2008, now U.S. Pat. No. 7,784,790, issued Aug. 31, 2010, which is a divisional of U.S. patent application Ser. No. 10/977,993, filed Oct. 29, 2004, now U.S. Pat. No. 7,322,576, issued Jan. 29, 2008, which is a continuation of U.S. patent application Ser. No. 10/286,985, filed Oct. 31, 2002, now abandoned, which is a continuation of U.S. patent application Ser. No. 09/690,051, filed Oct. 16, 2000, now U.S. Pat. No. 6,588,751, issued Jul. 8, 2003, which is a continuation-in-part of U.S. patent application Ser. No. 09/060,598, filed Apr. 15, 1998, now U.S. Pat. No. 6,254,096, issued Jul. 3, 2001.

TECHNICAL FIELD

The present invention relates to devices for handling cards, including cards known as playing cards. In particular, it relates to an electromechanical machine for continuously shuffling playing cards, whereby a dealer has a substantially continuously readily available supply of shuffled cards for dealing and whereby cards may be monitored for security purposes during play of the game.

BACKGROUND

Wagering games based on the outcome of randomly generated or selected symbols are well known. Such games are widely played in gaming establishments and include card games wherein the symbols comprise familiar, common or standard playing cards. Card games such as twenty-one or blackjack, poker, poker variations, match card games and the like are excellent casino card games. Desirable attributes of casino card games are that they are exciting, that they can be learned and understood easily by players, and that they move or are played rapidly to their wager-resolving outcome.

From the perspective of players, the time the dealer must spend in shuffling diminishes the excitement of the game. From the perspective of casinos, shuffling time reduces the number of wagers placed and resolved in a given amount of time, thereby reducing revenue. Casinos would like to maximize the amount of revenue generated by a game without changing games, without making obvious changes that indicate an increased hold by the house, particularly in a popular game, and without increasing the minimum size of wagers. One approach to maximizing revenue is speeding play. It is widely known that playing time is diminished by shuffling and dealing. This approach has led to the development of electromechanical or mechanical card-shuffling devices. Such devices increase the speed of shuffling and dealing, and reduce non-play time, thereby increasing the proportion of playing time to non-playing time, adding to the excitement of a game by reducing the time the dealer or house has to spend in preparing to play the game.

U.S. Pat. No. 4,515,367 to Howard is an example of a batch-type shuffler. The Howard patent discloses a card mixer for randomly interleaving cards including a carriage-supported ejector for ejecting a group of cards (approximately two playing decks in number), which may then be removed manually from the shuffler or dropped automatically into a chute for delivery to a typical dealing shoe.

U.S. Pat. No. 5,275,411 to Breeding discloses a machine for automatically shuffling a single deck of cards, including a deck receiving zone, a carriage section for separating a deck into two deck portions, a sloped mechanism positioned between adjacent corners of the deck portions, and an apparatus for snapping the cards over the sloped mechanism to interleave the cards.

U.S. Pat. No. 3,897,954 to Erickson et al. discloses the concept of delivering cards one at a time, into one of a number of vertically stacked card-shuffling compartments. The Erickson patent also discloses using a logic circuit to determine the sequence for determining the delivery location of a card, and that a card shuffler can be used to deal stacks of shuffled cards to a player. U.S. Pat. No. 5,240,140 to Huen discloses a card dispenser that dispenses or deals cards in four discrete directions onto a playing surface, and U.S. Pat. No. 793,489 to Williams, U.S. Pat. No. 2,001,918 to Nevius, U.S. Pat. No. 2,043,343 to Warner, and U.S. Pat. No. 3,312,473 to Friedman et al. disclose various card holders, some of which include recesses (e.g., Friedman et al.) to facilitate removal of cards. U.S. Pat. No. 2,950,005 to MacDonald and U.S. Pat. No. 3,690,670 to Cassady et al. disclose card-sorting devices that require specially marked cards, clearly undesirable for gaming and casino play.

U.S. Pat. Nos. 5,584,483 and 5,676,372 to Sines et al. describe batch-type shufflers that include a holder for an unshuffled stack of cards, a container for receiving shuffled cards, a plurality of channels to guide the cards from the unshuffled stack into the container for receiving shuffled cards, and an ejector mounted adjacent to the unshuffled stack for reciprocating movement along the unshuffled stack. The position of the ejector is randomly selected. The ejector propels a plurality of cards simultaneously from a number of points along the unshuffled stack, through the channels, and into the container. A shuffled stack of cards is made available to the dealer.

U.S. Pat. No. 5,695,189 to Breeding et al. is directed to a shuffling machine for shuffling multiple decks of cards with three magazines wherein unshuffled cards are cut then shuffled.

Aside from increasing speed and playing time, some shuffler designs have provided added protection to casinos. For example, one of the Breeding shufflers (similar to that described in U.S. Pat. No. 5,275,411) is capable of verifying that the total number of cards in the deck has not changed. If the wrong number of cards are counted, the dealer can call a misdeal and return bets to players.

A number of shufflers have been developed that provide a continuous supply of shuffled cards to a player. This is in contrast to batch-type shuffler designs of the type described above. The continuous shuffling feature not only speeds the game, but protects casinos against players who may achieve higher than normal winnings by counting cards or attempting to detect repeated patterns in cards from deficiencies of randomization in single-batch shufflers. An example of a card game in which a card counter may significantly increase the odds of winning by card counting or detecting previously occurring patterns or collections of cards is blackjack.

U.S. Pat. No. 4,586,712 to Lorber et al. discloses a continuous automatic shuffling apparatus designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe. The Lorber et al. shuffler counts the number of cards in the storage device prior to assigning cards to be fed to a particular location.

The Samsel, Jr. patent (U.S. Pat. No. 4,513,969) discloses a card shuffler having a housing with two wells for receiving stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players.

U.S. Pat. No. 5,382,024 to Blaha discloses a continuous shuffler having an unshuffled card receiver and a shuffled card receiver adjacent to and mounted for relative motion with respect to the unshuffled card receiver. Cards are driven from the unshuffled card receiver and are driven into the shuffled card receiver, forming a continuous supply of shuffled cards. However, the Blaha shuffler requires specially adapted cards, particularly plastic cards, and many casinos have demonstrated a reluctance to use such cards.

U.S. Pat. No. 5,000,453 to Stevens et al. discloses an apparatus for automatically and continuously shuffling cards. The Stevens et al. machine includes three contiguous magazines with an elevatable platform in the center magazine only. Unshuffled cards are placed in the center magazine and the spitting rollers at the top of the magazine spit the cards randomly to the left and right magazines in a simultaneous cutting and shuffling step. The cards are moved back into the center magazine by direct lateral movement of each shuffled stack, placing one stack on top of the other to stack all cards in a shuffled stack in the center magazine. The order of the cards in each stack does not change in moving from the right and left magazines into the center magazine.

U.S. Pat. No. 4,770,421 to Hoffman discloses a continuous card-shuffling device including a card-loading station with a conveyor belt. The belt moves the lowermost card in a stack onto a distribution elevator, whereby a stack of cards is accumulated on the distribution elevator. Adjacent to the elevator is a vertical stack of mixing pockets. A microprocessor preprogrammed with a fixed number of distribution schedules is provided for distributing cards into a number of pockets. The microprocessor sends a sequence of signals to the elevator corresponding to heights called out in the schedule. Single cards are moved into the respective pocket at that height. The distribution schedule is either randomly selected or schedules are executed in sequence. When the cards have been through a single distribution cycle, the cards are removed a stack at a time and loaded into a second elevator. The second elevator delivers cards to an output reservoir. Thus, the Hoffman patent requires a two-step shuffle, i.e., a program is required to select the order in which stacks are moved onto the second elevator. The Hoffman patent does not disclose randomly selecting a pocket for delivering each card. Nor does the patent disclose a single-stage process that randomly arranges cards into a degree of randomness satisfactory to casinos and players. Although the Hoffman shuffler was commercialized, it never achieved a high degree of acceptance in the industry. Card counters could successfully count cards shuffled in the device, and it was determined that the shuffling of the cards was not sufficiently random.

U.S. Pat. No. 5,683,085 to Johnson et al. describes a continuous shuffler that includes a chamber for supporting a main stack of cards, a loading station for holding a secondary stack of cards, a stack-gripping mechanism for separating or cutting cards in the main stack to create a space, and a mechanism for moving cards from the secondary stack into the spaces created in the main stack.

U.S. Pat. No. 4,659,082 to Greenberg discloses a carousel-type card dispenser including a rotary carousel with a plurality of card compartments around its periphery. Cards are injected into the compartments from an input hopper and ejected from the carousel into an output hopper. The rotation of the carousel is produced by a stepper motor with each step being equivalent to a compartment. In use, the carousel is rotated past n slots before stopping at the slot from which a card is to be ejected. The number n is determined in a random or near-random fashion by a logic circuit. There are 216 compartments to provide for four decks and eight empty compartments when all the cards are inserted into compartments. An arrangement of card edge-grasping drive wheels are used to load and unload the compartments.

U.S. Pat. No. 5,356,145 to Verschoor discloses another card shuffler involving a carousel, or "rotatable plateau." The Verschoor shuffler has a feed compartment and two card-shuffling compartments that each can be placed in first and second positions by virtue of the rotatable plateau on which the shuffling compartments are mounted. In use, once the two compartments are filled, a drive roller above one of the shuffling compartments is actuated to feed cards to the other compartment or to a discharge means. An algorithm determines which card is supplied to the other compartment and which is fed to the discharge. The shuffler is continuous in the sense that each time a card is fed to the discharge means, another card is moved from the feed compartment to one of the shuffling compartments.

U.S. Pat. No. 4,969,648 to Hollinger et al. discloses an automatic card shuffler of the type that randomly extracts cards from two or more storage wells. The shuffler relies on a system of solenoids, wheels and belts to move cards. Cards are selected from one of the two wells on a random basis, so a deck of intermixed cards from the two wells is provided in a reservoir for the dealer. The patent is principally directed to a method and apparatus for detecting malfunctions in the shuffler, which at least tends to indicate that the Hollinger et al. shuffler may have some inherent deficiencies, such as misalignments of extraction mechanisms.

The size of the buffer supply of shuffled cards in the known continuous shufflers is large, i.e., 40 or more cards in the case of the Blaha shuffler. The cards in the buffer cannot include cards returned to the shuffler from the previous hand. This undesirably gives the player some information about the next round.

Randomness is determined in part by the recurrence rate of a card previously played in the next consecutively dealt hand. The theoretical recurrence rate for known continuous shufflers is believed to be about zero percent. A completely random shuffle would yield a 13.5% recurrence rate using four decks of cards.

Although the devices disclosed in the preceding patents, particularly the Breeding machines, provide improvements in card-shuffling devices, none describes a device and method for providing a continuous supply of shuffled cards with the degree of randomness and reliability required by casinos until the filing of U.S. patent application Ser. No. 09/060,598, now U.S. Pat. No. 6,254,096, issued Jul. 3, 2001. That device and method continuously shuffles and delivers cards with an improved recurrence rate and improves the acceptance of card shufflers and facilitates the casino play of card games.

BRIEF SUMMARY

The present invention provides an electromechanical card-handling apparatus and method for continuously shuffling cards. The apparatus and, thus, the card-handling method or process, is controlled by a programmable microprocessor and may be monitored by a plurality of sensors and limit switches. While the card-handling apparatus and method of the present invention is well suited for use in the gaming environment, particularly in casinos, the apparatus and method may find use in handling or sorting sheet material generally.

In one embodiment, the present invention provides an apparatus for moving playing cards from a first group of unshuffled cards into shuffled groups of cards. The apparatus comprises a card receiver for receiving the first group of cards, a single stack of card-receiving compartments generally adjacent to the card receiver, the stack generally vertically movable, an elevator for raising and lowering the stack, a card-moving mechanism between the card receiver and the stack for moving cards, one at a time, from the card receiver to a selected compartment, and a microprocessor that controls the card-moving mechanism and the elevator so that the cards are moved into a number of randomly selected compartments. Sensors act to monitor and to trigger operation of the apparatus, the card-moving mechanism, and the elevator, and also provide information to the microprocessor. The controlling microprocessor, including software, selects or identifies where cards will go as to the selected slot or compartment before card-handling operations begin. For example, a card designated as card 1 may be directed to slot 5, a card designated as card 2 may be directed to slot 7, a card designated as card 3 may be directed to slot 3, etc.

An advantage of the present invention is that it provides a programmable card-handling machine with a display and appropriate inputs for controlling and adjusting the machine. Additionally, there may be an elevator speed adjustment and sensor to adjust and monitor the position of the elevator as cards wear or become bowed or warped. These features also provide for interchangeability of the apparatus, meaning the same apparatus can be used for many different games and in different locations, thereby reducing or eliminating the number of backup machines or units required at a casino. Since it is customary in the industry to provide free backup machines, a reduction in the number of backup machines needed presents a significant cost savings. The display may include a use rate and/or card count monitor and display for determining or monitoring the usage of the machine.

Another advantage of the present invention is that it provides an electromechanical playing card-handling apparatus for automatically and randomly generating a continuous supply of shuffled playing cards for dealing. Other advantages are a reduction of dealer shuffling time, and a reduction or elimination of security problems, such as card counting, possible dealer manipulation and card tracking, thereby increasing the integrity of a game and enhancing casino security.

Yet another advantage of the card-handling apparatus of the present invention is that it converts a single deck, multiple decks, any number of unshuffled cards or large or small groups of discarded or played cards into shuffled cards ready for use or reuse in playing a game. To accomplish this, the apparatus includes a number of stacked or vertically oriented card-receiving compartments one above another into which cards are inserted, one at a time, so a random group of cards is formed in each compartment and until all the cards loaded into the apparatus are distributed to a compartment. Upon demand, either from the dealer or a card present sensor, or automatically, the apparatus delivers one or more groups of cards from the compartments into a dealing shoe for distribution to players by the dealer.

The present invention may include jammed card detection and recovery features, and may include recovery procedures operated and controlled by the microprocessor.

Another advantage is that the apparatus of the present invention provides for the initial top feeding or loading of an unshuffled or discarded group of cards, thereby facilitating use by the dealer. The shuffled card-receiving shoe portion is adapted to facilitate use by a dealer.

An additional advantage of the card-handling apparatus of the present invention is that it facilitates and speeds the play of casino wagering games, particularly those games wherein multiple decks of cards are used in popular, rapidly played games (such as twenty-one or blackjack), making the games more exciting for players.

In use, the apparatus of the present invention is operated to process playing cards from an initial, unshuffled new or played group of cards into a group of shuffled or reshuffled cards available to a dealer for distribution to players. The first step of this process is the dealer placing an initial group of cards, comprising unshuffled or played cards, into the card receiver of the apparatus. The apparatus is started or starts automatically by sensing the presence of the cards and, under the control of the integral microprocessor, it transfers the initial group of cards, randomly, one at a time, into a plurality of compartments. Groups of cards in one or more compartments are delivered, upon the dealer's demand or automatically, by the apparatus from that compartment to a card-receiving shoe for the dealer to distribute to a player.

According to the present invention, the operation of the apparatus is continuous. That is, once the apparatus is turned on, any group of cards loaded into the card receiver will be entirely processed into one or more groups of random cards in the compartments. The software assigns an identity to each card and then directs each identified card to a randomly selected compartment by operating the elevator motor to position that randomly selected compartment to receive the card. The cards are unloaded in groups from the compartments, a compartment at a time, as the need for cards is sensed by the apparatus. Thus, instead of stopping play to shuffle or reshuffle cards, a dealer always has shuffled cards available for distribution to players.

The apparatus of the present invention is compact, easy to set up and program and, once programmed, can be maintained effectively and efficiently by minimally trained personnel who cannot affect the randomness of the card delivery. This means that the machines are more reliable in the field. Service costs are reduced, as are assembly and setup costs.

Another concern in continuous shufflers is the fact that there has been no ability to provide strong security evaluation in the continuous shufflers, because of the very fact that the cards are continuously being reshuffled, with cards present within and outside the shuffler. This offers an increased risk of cards being added to the deck by players or being removed and held back by players. This is a particular concern in games where the players are allowed to contact or pick up cards during play (e.g., in certain poker-type games and certain formats for blackjack). The present invention provides a particular system wherein the total number of cards in play at the table may be counted with minimal game interruption.

The system of the present invention, in addition to allowing a security check on the number of cards present in the collection of decks, allows additional cards, such as promotional cards or bonus cards, to be added to the regular playing cards, the total number of cards allowable in play modified to the number of regular playing cards plus additional (e.g., special) playing cards, allowing the shuffler to be modified for a special deck or deck(s) where there are fewer cards than normal (e.g., SPANISH 21® blackjack game), or otherwise modified at the discretion of the house. Therefore, the shuffler would not be limited to counting security for only direct multiples of conventional 52-card playing decks. The shuffler may be provided with specific selection features wherein a game may be identified to the microprocessor and the appropriate number of cards for that game may become the default security count for the game selected.

The present invention also describes a structural improvement in the output shoe cover to prevent cards that are already within the shoe from interfering with the delivery of additional cards to the shoe.

A novel gravity feed/diverter system is described to reduce the potential for jamming and to reduce the chance for multiple cards to be fed from a card feeder into selected card-receiving compartments.

Other features and advantages of the present invention will become more fully apparent and understood with reference to the following specification and to the appended drawings and claims.

DETAILED DESCRIPTION

Figure 1:
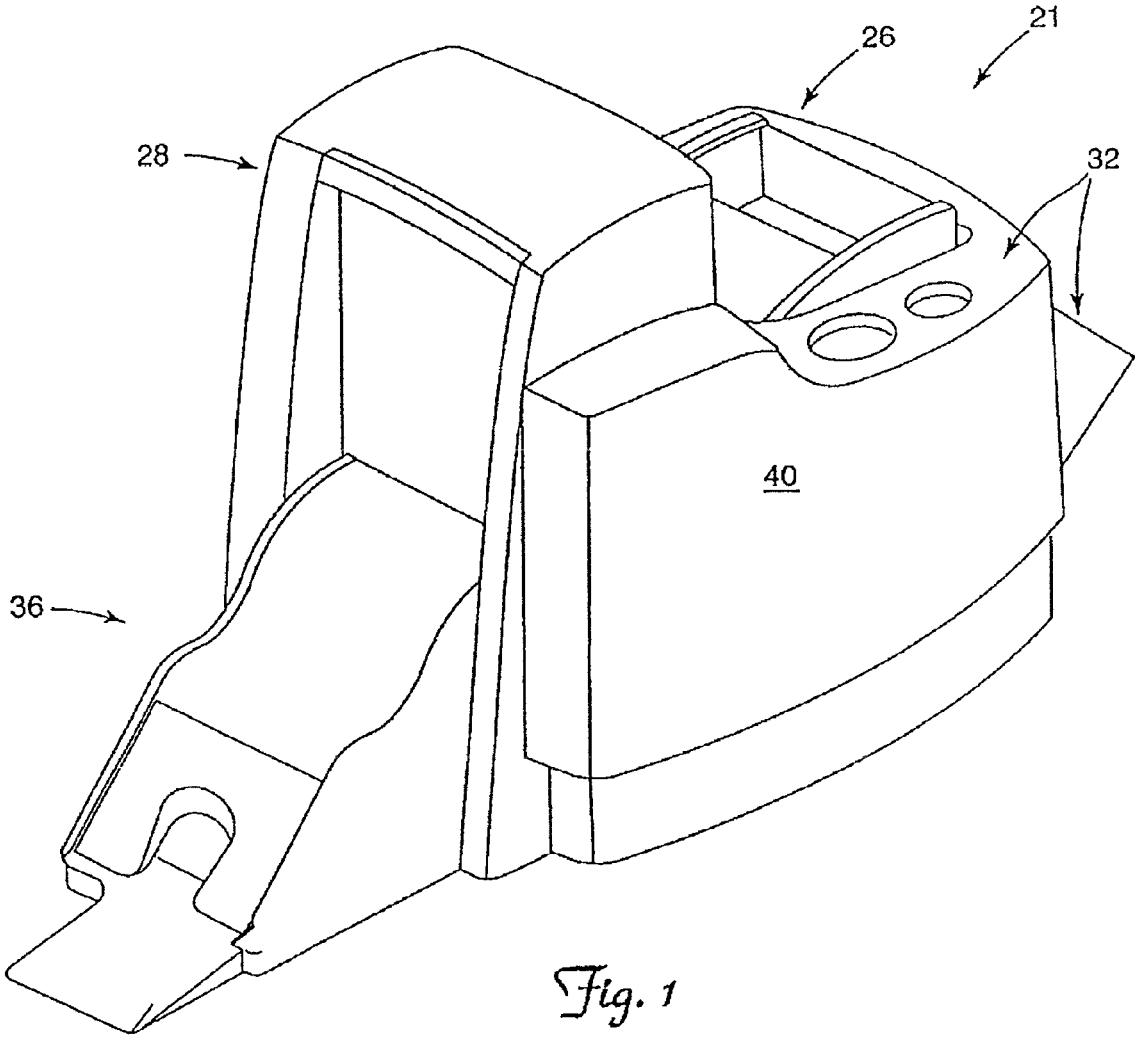
FIG. 1 is a front perspective view depicting a card-handling apparatus of the present invention as it might be disposed ready for use in a casino on a gaming table.

This detailed description is intended to be read and understood in conjunction with appended Appendices A and B, which are incorporated herein by reference. Appendix A provides an identification key correlating the description and abbreviation of certain motors, switches and photoeyes or sensors with reference character identifications of the same components in the Figures, and gives the manufacturers, addresses and model designations of certain components (motors, limit switches and sensors). Appendix B outlines steps in a horning sequence, part of one embodiment of the sequence of operations.

With regard to means for fastening, mounting, attaching or connecting the components of the present invention to form the apparatus as a whole, unless specifically described as otherwise, such means are intended to encompass conventional fasteners such as machine screws, rivets, nuts and bolts, toggles, pins and the like. Other fastening or attachment means appropriate for connecting components include adhesives, welding and soldering, the latter particularly with regard to the electrical system of the apparatus.

All components of the electrical system and wiring harness of the present invention are conventional, commercially available components unless otherwise indicated, including electrical components and circuitry, wires, fuses, soldered connections, chips, boards and control system components.

Generally, unless specifically otherwise disclosed or taught, the materials for making the various components of the present invention are selected from appropriate materials, such as metal, metallic alloys, ceramics, plastics, fiberglass and the like, and components and materials may be similar to or adapted from components and material used to make the card-handling apparatus disclosed and described in U.S. patent application Ser. No. 09/060,627, entitled Device and Method For Forming Hands of Randomly Arranged Cards, filed on Apr. 15, 1998, now U.S. Pat. No. 6,149,154, issued Nov. 21, 2000 and incorporated herein by reference.

In the following description, the Appendices and the claims, any references to the terms right and left, top and bottom, upper and lower and horizontal and vertical are to be read and understood with their conventional meanings and with reference to viewing the apparatus generally from the front as shown in FIG. 1.

Figure 3:
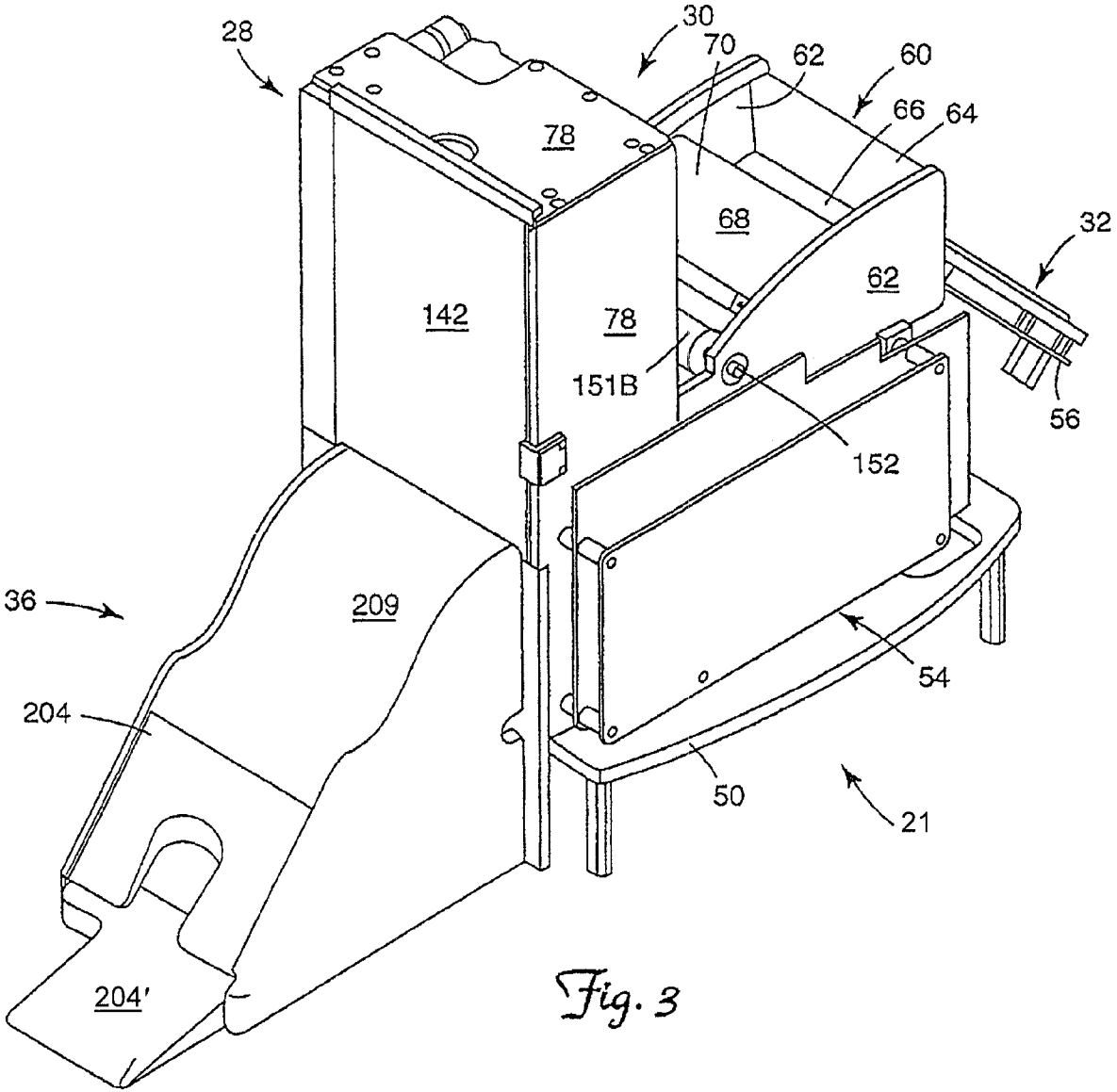
FIG. 3 is a front perspective view of the card-handling apparatus of the present invention with portions of an exterior shroud removed.
Figure 4:
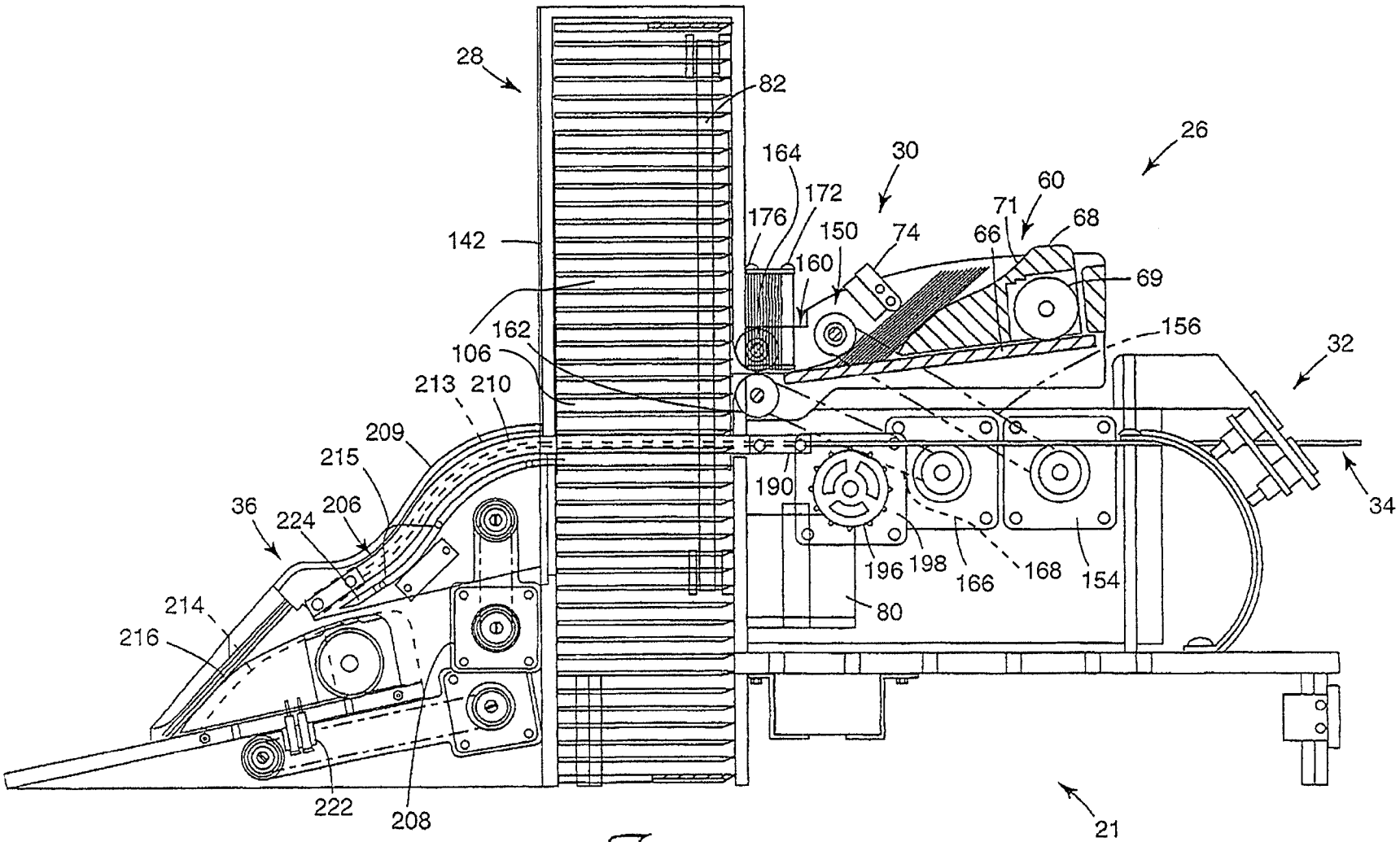
FIG. 4 is a side elevation view of the present invention with the exterior shroud and other portions of the card-handling apparatus removed to show internal components.

Referring then to the Figures, particularly FIGS. 1, 3 and 4, a card-handling apparatus 21 of the present invention includes a card receiver 26 for receiving a group of cards to be randomized or shuffled, a single stack, or rack assembly 28, of card-receiving compartments 106 (see FIGS. 4 and 9) generally adjacent to the card receiver 26, a card-moving or card-transporting mechanism 30 (see FIGS. 3 and 4) between and linking the card receiver 26 and the card-receiving compartments 106, and a processing unit, indicated generally at 54 in FIG. 3, that controls the card-handling apparatus 21. The card-handling apparatus 21 includes a second card-moving mechanism 34 (see FIGS. 4, 8 and 8A) for emptying the card-receiving compartments 106 into a second card receiver 36.

Figure 2:
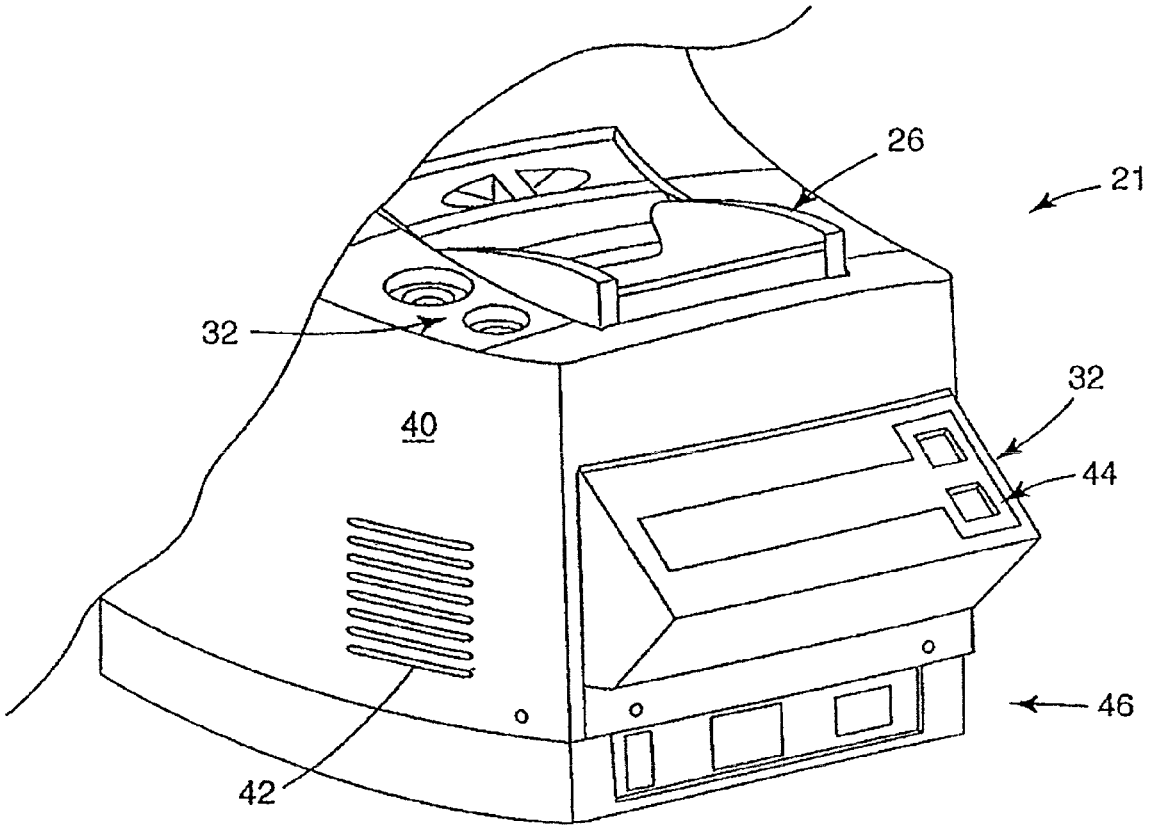
FIG. 2 is a rear perspective view, partially broken away, of the card-handling apparatus of the present invention.

Referring to FIGS. 1 and 2, the card-handling apparatus 21 includes a removable, substantially continuous exterior housing shroud 40. The shroud 40 may be provided with appropriate vents 42 for cooling. The card receiver or initial loading region, indicated generally at 26 is at the top, rear of the apparatus 21, and the second card receiver 36 is at the front of the apparatus 21. Controls and/or display features 32 are generally at the rear, or dealer-facing side, of the card-handling apparatus 21. FIG. 2 provides a rear view of the apparatus 21 and more clearly shows the controls and/or display features 32, including power input and communication port 46.

FIG. 3 depicts the apparatus 21 with the shroud 40 removed, as it might be for servicing or programming, whereby internal components may be visualized. The apparatus 21 includes a generally horizontal frame floor 50 for mounting and supporting operational components. A control (input and display) module 56 is cantilevered at the rear of the apparatus 21, and is operably connected to the operational portions of the apparatus 21 by suitable wiring or the like. The control module 56 may carry the microprocessor (not shown), or preferably, the microprocessor may be located on processing unit 54 on the frame floor 50 inside the shroud 40. The inputs and display portion 44 of the control module 56 are fitted to corresponding openings in the shroud 40, with associated circuitry and programming inputs located securely within the shroud 40 when it is in place, as shown in FIGS. 1 and 2.

In addition, the present invention generically and specifically includes a card handler or shuffling device comprising:

- a card staging area for receiving cards to be handled;
- a plurality of card-receiving compartments, wherein the card staging area (and a card mover) and the card-receiving compartments are relatively movable;
- a card mover generally between the card staging area and the card-receiving compartments for moving a card from the card staging area into one of the card-receiving compartments;
- a microprocessor programmed to identify each card in the card staging area and to relatively actuate the card mover to move an identified card to a randomly selected card-receiving compartment, wherein the microprocessor is programmable to deliver a selected number of cards to a card-receiving compartment;
- a drive system responsive to the microprocessor for relatively moving the card-receiving compartments; and
- a counting system for counting cards within specified areas within the card handler.

The terms "relatively actuate" and "relatively move" are used in this description to emphasize the point that there should be relative movement between the card-receiving compartments and the card mover/card staging area. Relative movement may be caused by movement of the rack of card-receiving compartments only, movement of the card mover only, or by movement of both the rack of card-receiving compartments and the card mover/staging area. The alignment of the card mover and the moving of the card may be done as separate (in time) steps or as simultaneous steps, with either the card mover moving and being fed a card at the same time or having the card fed at a time distinct from the moving of the card mover.

The card handler counting system preferably counts cards entering and leaving the plurality of card-receiving compartments. There may be present a card-moving system to move cards from the plurality of card-receiving compartments to a second card-receiving area. The card handler may have the counting system count cards entering and leaving the plurality of card-receiving compartments and cards entering and leaving the second card-receiving area, and the counting system may maintain a rolling count of the cards within both the plurality of card-receiving compartments and the second card-receiving area. This format could use inputs operably coupled to the microprocessor for inputting information into the microprocessor.

A playing card handler according to the present invention may also comprise:

- a stack of card-receiving compartments for accumulating cards in at least one card-receiving compartment;
- a microprocessor programmed to randomly select the card-receiving compartment that receives each card in a manner sufficient to accomplish randomly arranging the cards in each card-receiving compartment, wherein the microprocessor is programmable to deliver a selected number of cards to a selected number of card-receiving compartments;
- a card staging area for receiving a stack of cards to be handled, wherein the stack of card-receiving compartments and the card staging area are movable relative to each other, by any one being independently movable or by both being movable;
- card-moving means responsive to output signals from the microprocessor for moving between the staging area and the stack of compartments;
- a card mover for moving cards from the compartments to a second card receiver; and
- the microprocessor performing as a counting system for counting cards within specified areas within the card handler.

This apparatus may further comprise a data storage medium accessible by the microprocessor, wherein the data storage medium has a program stored on it, and wherein the program is configured to cause the microprocessor to cause the card-moving means to move cards from the card staging area to random compartments. The microprocessor may monitor, record and control a display for the use of the apparatus. The apparatus may further comprise at least one sensor for monitoring the movement of cards and the data storage medium may be further configured to cause the microprocessor to detect a card jam.

A method according to the present invention for substantially continuously replenishing a group of processed cards may comprise:

- providing a card receiver for receiving cards to be processed;
- providing a single stack of card-receiving compartments generally adjacent to the card receiver and means for moving the stack relative to a card-moving mechanism;
- providing a card-moving mechanism between the card receiver and the stack for moving cards from the card receiver to the card-receiving compartments;
- providing a second card receiver for receiving processed cards;
- providing a second card-moving mechanism for moving cards from the compartments to the second card receiver; and
- counting cards within specified areas within a card handler.

Card Receiver

Figure 6:
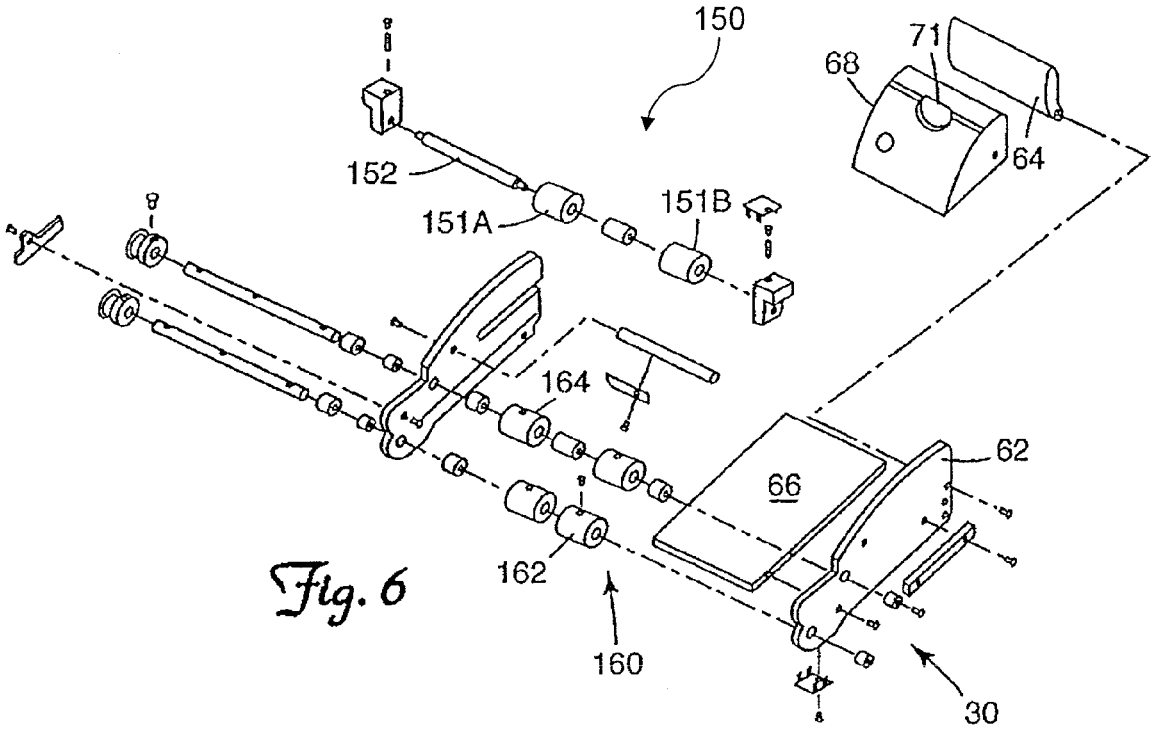
FIG. 6 is an exploded assembly view of the transport mechanism shown in FIG. 5.

Referring to FIGS. 3 and 4, the card receiver or loading region 26 includes a card-receiving well 60. The card-receiving well 60 is defined by upright, generally parallel card-guiding side walls 62 and a rear wall 64. It includes a floor surface 66 pitched or angled downwardly toward the front of the apparatus 21. Preferably, the floor surface 66 is pitched from the horizontal at an angle ranging from approximately five to twenty degrees, with a pitch of seven degrees being preferred. A removable, generally rectangular weight or block 68 is freely and slidably received in the well 60 for free forward and rearward movement along the floor surface 66. Under the influence of gravity, the block 68 will tend to move toward the forward end of the well 60. The block 68 has an angled, card-contacting front face 70 for contacting the back (i.e., the bottom of the bottommost card) of a group of cards placed into the well 60, and urges cards (i.e., the top card of a group of cards) forward into contact with the card-transporting mechanism 30. The card-contacting front face 70 of the block 68 is at an angle complimentary to the floor surface 66 of the well 60, for example, an angle of between approximately 10 and 80 degrees, and preferably at an angle of 40 degrees. This angle and the weight of the block 68 keep the cards urged forwardly against the card-transporting mechanism 30. The selected angle of the floor surface 66 and the weight of the block 68 allow for the free-floating rearward movement of the cards and the block 68 to compensate for the rearward force and movement generated as the top or forwardmost card contacts the card-transporting mechanism 30 and begins to move. The well 60 includes a card present sensor 74 to sense the presence or absence of cards in the well 60. Preferably, the block 68 is mounted on a roller 69 for easing the movement of the block 68, and/or the floor surface 66 and the bottom of the block 68 may be formed of or coated with friction-reducing material. As shown in FIG. 6, the block 68 may have a thumb or finger-receiving notch 71 to facilitate moving it.

Card-Receiving Compartments

Figure 9:
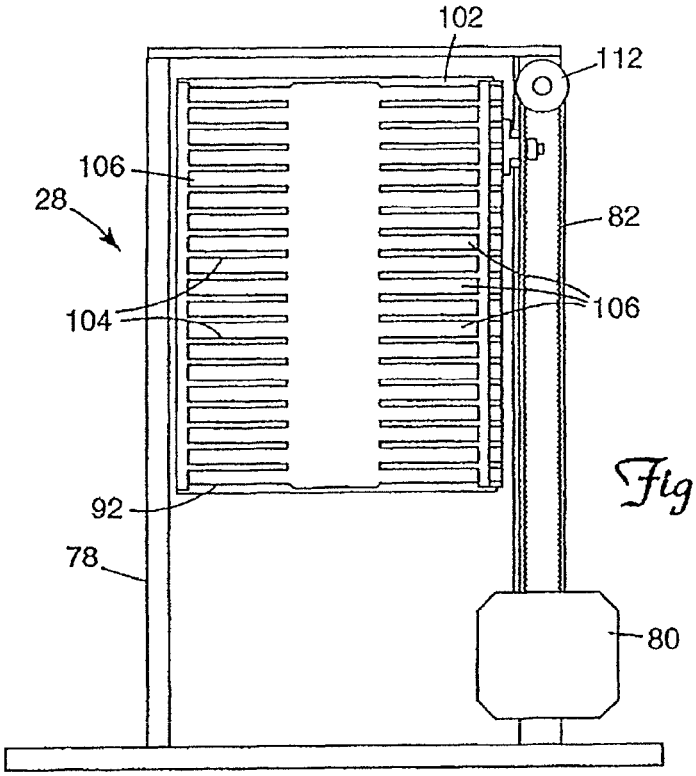
FIG. 9 is a front elevation view of a rack and elevator assembly.
Figure 10:
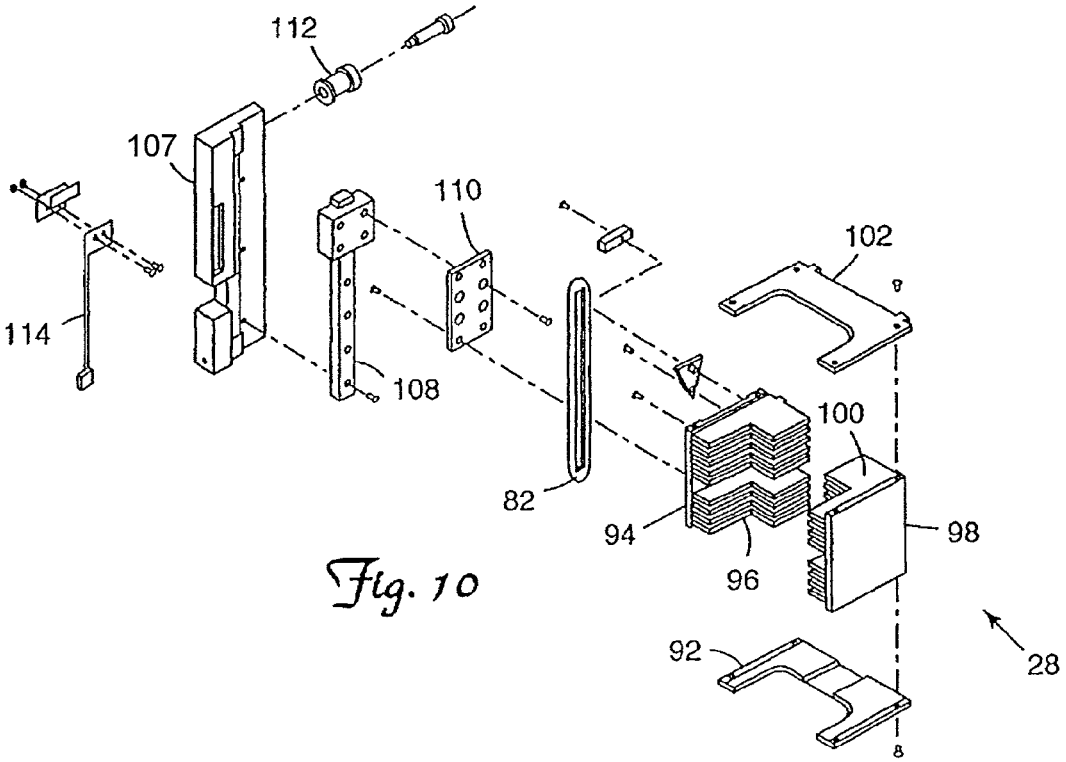
FIG. 10 is an exploded assembly view of one embodiment of a portion of the rack and elevator assembly.

The assembly or stack of card-receiving compartments 28 is depicted in FIGS. 4, 9 and 10, and may also be referred to as a rack assembly. Referring back to FIG. 3, the rack assembly 28 is housed in an elevator and rack assembly housing 78 generally adjacent to the well 60, but horizontally spaced therefrom. An elevator motor 80 is provided to position the rack assembly 28 vertically under control of a microprocessor, in one embodiment, generally part of the processing unit 54. The motor 80 is linked to the rack assembly 28 by a continuous resilient member, such as a timing belt 82. Referring to FIG. 10, which depicts a portion of the rack assembly 28 and how it may be assembled, the rack assembly 28 includes a bottom plate 92, a left-hand rack 94 carrying a plurality of half shelves 96, a right-hand rack 98 including a plurality of half shelves 100 and a top plate 102. Together the right- and left-hand racks 94, 98 and their respective half shelves 96, 100 form individual plate-like shelf members 104 for forming the top and bottom walls of individual compartments 106. The rack assembly 28 is operably mounted to the apparatus 21 by a left-side rack plate 107 and a linear guide 108. It is attached to the guide by a guide plate 110. The timing belt 82 links the motor 80 to a pulley 112 for driving the rack assembly 28 up and down. A Hall effect switch assembly 114 is provided to sense the bottom position of the rack assembly 28.

Figure 7:
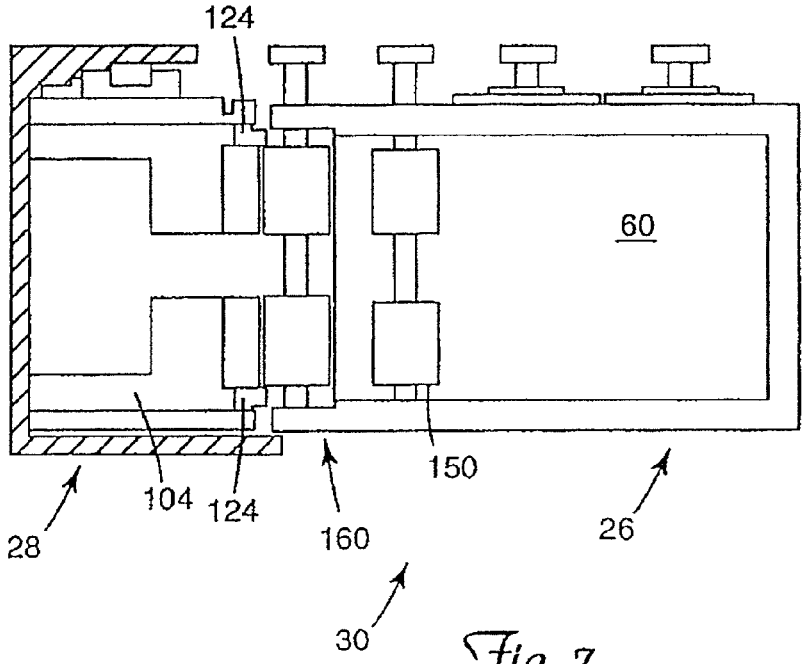
FIG. 7 is a top plan view, partially in section, of the transport mechanism.

FIG. 9 depicts a rack assembly 28 having 19 individual compartments 106 for receiving cards. Generally speaking, a larger number of individual compartments is preferred over fewer compartments, with 17 to 19 compartments being most preferred for randomizing four decks of cards, but it should be understood that the present invention is not limited to a rack assembly of seventeen to nineteen compartments. Preferably, the compartments 106 are all substantially the same size, i.e., the plate-like shelf members 104 are substantially equally vertically spaced from each other. FIG. 7 shows, in part, a top plan view of one of the shelf members 104 and that includes a pair of rear tabs 124 located at respective rear corners of the plate-like shelf member 104. The tabs 124 are for card guiding, and help make sure cards are moved from the card-transporting mechanism 30 into the rack assembly 28 without jamming by permitting the leading edge of the card to be guided downwardly into the compartment 106 before the card is released from the card-moving or card-transporting mechanism 30. Generally, it is desirable to mount the plate-like shelf members 104 as close to the card-transporting mechanism 30 as possible.

Figures 11, 12:
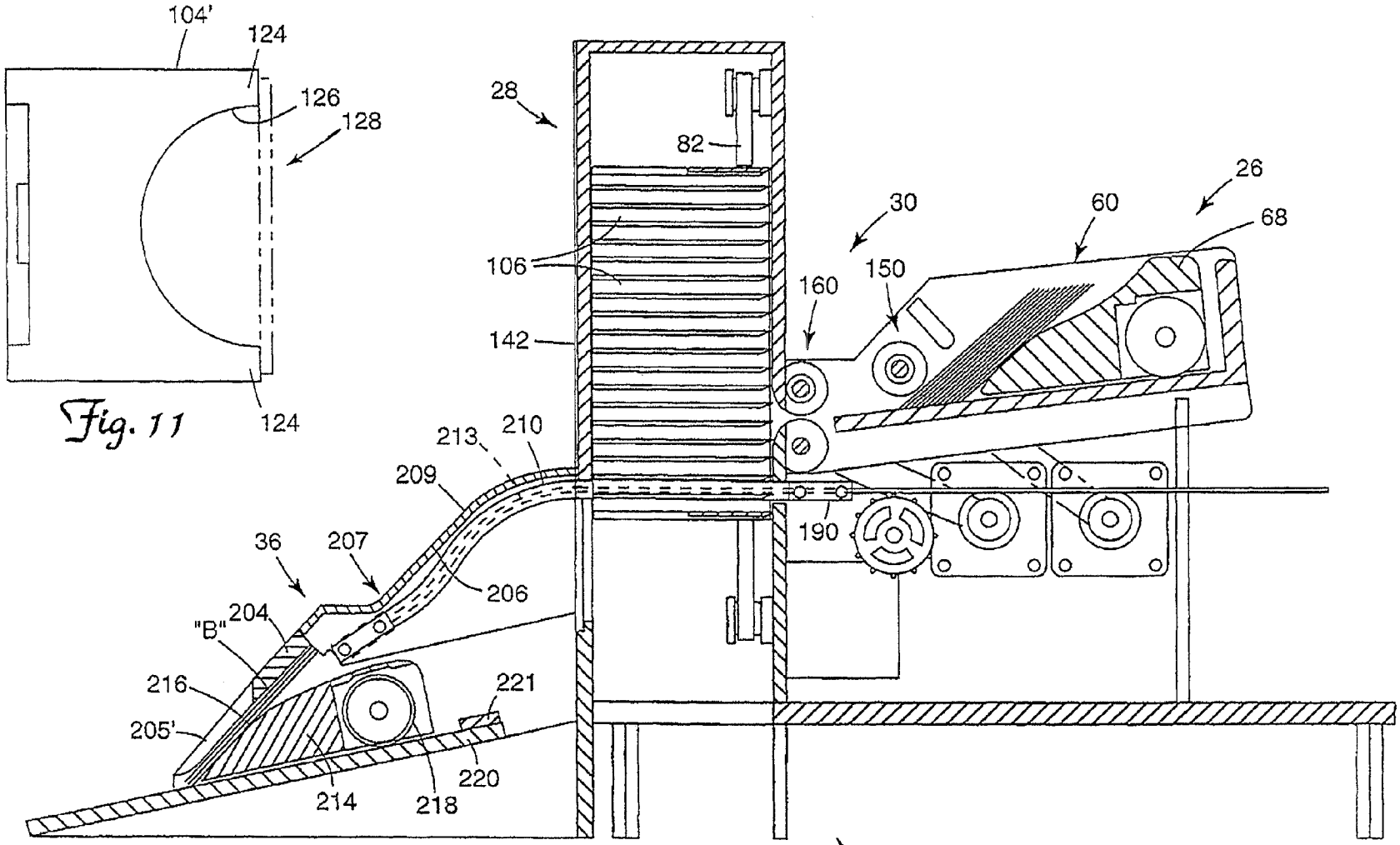
FIG. 11 depicts an alternative embodiment of the shelves for forming the compartments of the rack assembly of the present invention.
FIG. 12 is a simplified side cross-sectional view, largely representational, of the card-handling apparatus of the present invention.

FIG. 11 depicts an alternative embodiment of plate-like shelf members 104 comprising a single-piece plate member 104'. An appropriate number of the single-piece plates, corresponding to the desired number of compartments 106, would be connected between the side walls 62 of the rack assembly 28. The single-piece plate member 104' depicted in FIG. 11 includes a curved or arcuate edge portion 126 on a rear edge 128 of plate 104' for removing cards or clearing jammed cards, and it includes the two bilateral tabs 124, also a feature of the shelf members 104 of the rack assembly 28 depicted in FIG. 7. The tabs 124 act as card guides and permit the plate-like shelf members 104 forming the compartments 106 to be positioned as closely as possible to the card-transporting mechanism 30 to ensure that cards are delivered correctly into a compartment 106, even though the cards may be warped or bowed.

Figure 5:
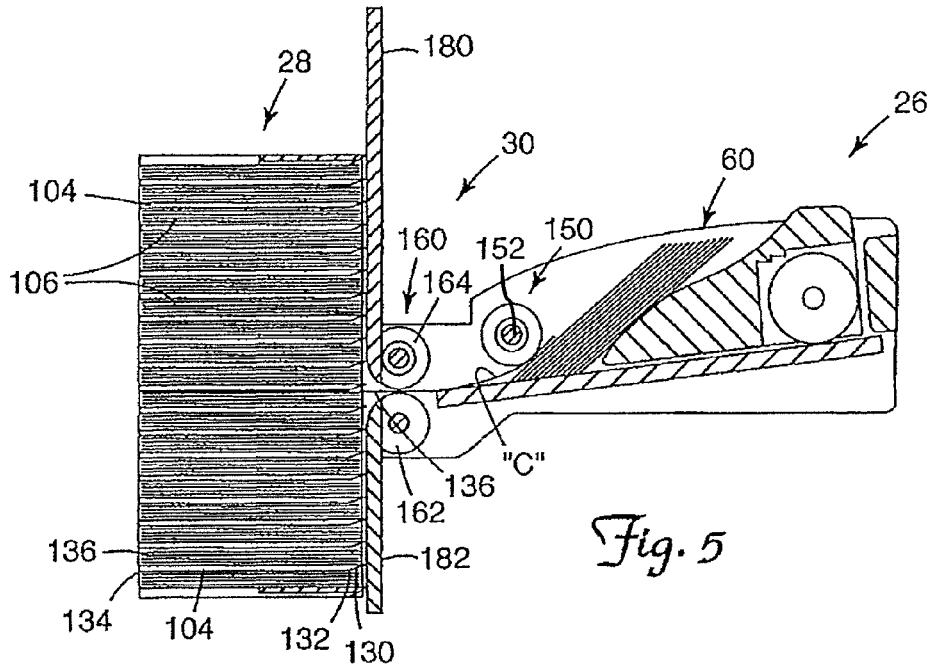
FIG. 5 is a side elevation view, largely representational, of a transport mechanism and rack assembly of the card-handling apparatus of the present invention.
Figure 5A:
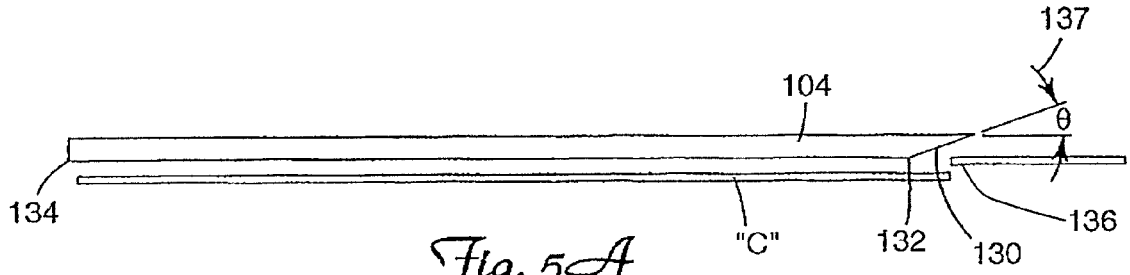
FIG. 5A is an expanded side elevation view of a shelf as shown in FIG. 5, showing more detail of the rack assembly, particularly shelves forming the top and bottom compartments of the rack assembly.

Referring to FIG. 5, an advantage of the plate-like shelf members 104 (and/or the half plates 96, 100) forming the compartments 106 is depicted. As shown in more detail in FIG. 5A , each plate-like shelf member 104 includes a beveled or angled underside rearmost surface 130 in the space between the plate-like shelf members 104, i.e., in each compartment 106. Referring to FIG. 5, the distance between a forward edge 134 of the plate 104 and a forward edge 132 of the bevel 130 is preferably less than the width of a typical card. A leading edge 136 of a card being driven into a compartment 106 hits the beveled surface 130 and falls down on the top of cards already in the compartment 106 so that it comes to rest properly in the compartment 106 or on the uppermost card of cards already delivered to the compartment 106. To facilitate a bevel 130 at a suitable angle 137, a preferred thickness for the plate-like shelf members 104 is approximately 3/32 of an inch, but this thickness and/or the angle 137 of bevel 130 can be changed or varied to accommodate different sizes of cards, such as poker and bridge cards. Preferably, the angle 137 of bevel 130 is between approximately ten and 45 degrees and, more preferably, between approximately fifteen and twenty degrees. Whatever angle 137 and thickness is selected for bevel 130 and plate-like shelf members 104, respectively, it is preferred that cards "C" should come to rest with their trailing edge at least even with and, preferably, rearward of forward edge 134 of the plate-like shelf members 104.

The front of the rack assembly 28 is closed by a removable cover 142 (see FIG. 3), which may be formed of opaque, transparent or semi-transparent material such as suitable metal or plastic.

Card-Moving Mechanism

Referring to FIGS. 4, 5 and 6, a preferred card-transporting or card-moving mechanism 30 linking the card-receiving well 60 and the compartments 106 of the rack assembly 28 includes a card pick-up roller assembly 150. The card pick-up roller assembly 150 is located generally at the forward portion of the well 60. The pick-up roller assembly 150 includes friction rollers 151A, 151B supported by a bearing-mounted axle 152 extending generally across the well 60, whereby the card-contacting surfaces of the friction rollers 151A, 151B are in close proximity to the forward portion of the floor surface 66. The pick-up roller assembly 150 is driven by a pick-up motor 154 operably coupled to the axle 152 by a suitable continuous connector 156, such as a belt or chain. The card-contacting surfaces of the friction rollers 151A, 151B may be generally smooth, they may be textured or they may include one or more finger or tab-like extensions, as long as card gripping and moving is not impaired.

With continued reference to FIGS. 4, 5 and 6, the preferred card-moving mechanism 30 includes a pinch roller card accelerator or speed-up system 160 located adjacent to the front of the well 60, generally between the well 60 and the rack assembly 28, and forward of the pick-up roller assembly 150. As shown in FIG. 7, the speed-up system 160 nests close to the shelves 104 between the tabs 124 of the plate-like shelf members 104. Referring back to FIGS. 4, 5 and 6, the speed-up system 160 comprises a pair of axle-supported, closely adjacent speed-up rollers, one above the other, including a lower roller 162 and an upper roller 164. The upper roller 164 may be urged toward the lower roller 162 by a spring assembly (not shown) or the rollers 162 and 164 may be fixed in slight contact or near-contact and formed of a generally firm yet resilient material that gives just enough to admit a card. Referring to FIG. 4, the lower roller 162 is driven by a speed-up motor 166 operably linked to it by a suitable connector 168 such as a belt or a chain. The mounting for the speed-up rollers also supports a rearward card in sensor 172 and a forward card out sensor 176. FIG. 5 is a largely representational view depicting the relationship between the card-receiving well 60 and the card-transporting mechanism 30, and also shows a card "C" being picked up by the pick-up roller assembly 150 and being moved into the pinch roller system 160 for acceleration into a compartment 106 of the rack assembly 28.

In one embodiment, the pick-up roller assembly 150 is not continuously driven, but rather indexes and includes a one-way clutch mechanism. After initially picking up a card and advancing it into the speed-up system 160, the pick-up roller motor 154 stops when the leading edge of a card hits the card out sensor 176, but the pick-up roller assembly 150 free-wheels as a card is accelerated from under it by the speed-up system 160. In one embodiment, the speed-up pinch system 160 is continuous in operation once a cycle starts. When the trailing edge of the card passes the card out sensor 176, the rack assembly 28 moves the next designated compartment into place for receiving a card. The pick-up motor 154 then reactuates.

Additional components and details of the card-transporting mechanism 30 are depicted in FIG. 6, an exploded assembly view thereof. In FIG. 6 the inclined floor surface 66 of the well 60 is visible, as are the axle-mounted pick-up and pinch roller assemblies 150, 160, respectively, and their relative positions.

Referring to FIGS. 4 and 5, the card-transporting mechanism 30 includes a pair of generally rigid stopping plates, including an upper stop plate and a lower stop plate 180, 182, respectively. The stop plates 180, 182 are fixedly positioned between the rack assembly 28 and the speed-up system 160 immediately forward of and above and below the pinch rollers 162, 164. The stop plates 180, 182 stop the cards from rebounding or bouncing rearwardly, back toward the pinch rollers 162, 164, after they are driven against and contact the cover 142 at the front of the rack assembly 28.

Processing/Control Unit

Figure 14:
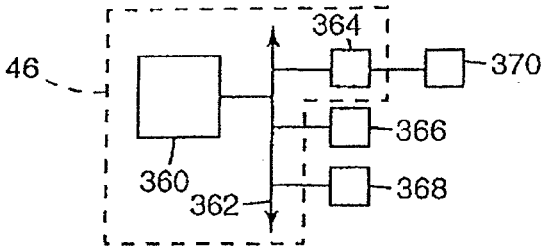
FIG. 14 is a schematic diagram of an electrical control system for one embodiment of the present invention.

FIG. 14 is a block diagram depicting an electrical control system that may be used in one embodiment of the present invention. The control system includes a controller 360, a bus 362, and a motor controller 364. Also represented in FIG. 14 are inputs 366, outputs 368, and a motor system 370. The controller 360 sends signals to both the motor controller 364 and the outputs 368 while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 by sending appropriate signals over the bus 362.

In a preferred embodiment of the present invention, the motor system 370 comprises motors that are used for operating components of the card-handling apparatus 21. Motors operate the pick-up roller, the pinch, speed-up rollers, the pusher and the elevator. The gate and stop may be operated by a motor, as well. In such an embodiment, the motor controller 364 would normally comprise one or two controllers and driver devices for each of the motors used. However, other configurations are possible.

The outputs 368 include, for example, alarm, start, and reset indicators and inputs, and may also include signals that can be used to drive a display device (e.g., an LED display—not shown). Such a display device can be used to implement a timer, a card counter, or a cycle counter. Generally, an appropriate display device can be configured and used to display any information worthy of display.

The inputs 366 include information from the limit switches and sensors described above. Other inputs might include data inputted through operator or user controls. The controller 360 receives the inputs 366 over the bus 362.

Figure 15:
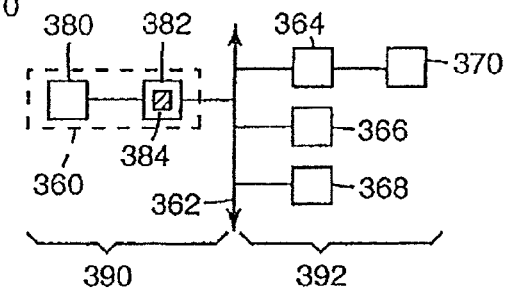
FIG. 15 is a schematic diagram of another electrical control system.
Figure 16:
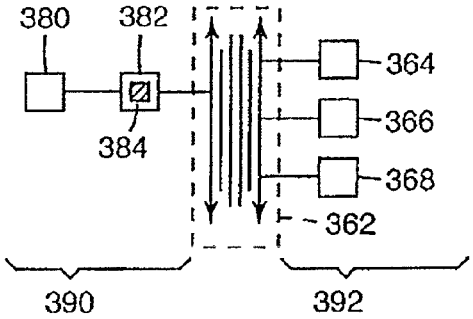
FIG. 16 is a schematic diagram of an electrical control system with an optically isolated bus.

Although the controller 360 can be any digital controller or microprocessor-based system, in a preferred embodiment, the controller 360 comprises a processing unit 380 and a peripheral device 382 as shown in FIG. 16. The processing unit 380 in the preferred embodiment may be an 8-bit single-chip microcontroller such as an 80C52, manufactured by the Intel Corporation of Santa Clara, Calif. The peripheral device 382 may be a field-programmable microcontroller peripheral device that includes programmable logic devices, EPROMs, and input-output ports. As shown in FIG. 15, peripheral device 382 interfaces the processing unit 380 to the bus 362.

The series of instructions stored in the controller 360 is shown in FIGS. 15 and 16 as program logic 384. In a preferred embodiment, the program logic 384 is RAM or ROM hardware in the peripheral device 382. (Since the processing unit 380 may have some memory capacity, it is possible that some of the instructions are stored in the processing unit 380.) As one skilled in the art will recognize, various implementations of the program logic 384 are possible. The program logic 384 could be either hardware, software, or a combination of both. Hardware implementations might involve hardwired code or instructions stored in a ROM or RAM device. Software implementations would involve instructions stored on magnetic, optical, or other media that can be accessed by the processing unit 380. Under certain conditions, it is possible that a significant amount of electrostatic charge may build up in the card-handling apparatus 21. Significant electrostatic discharge could affect the operation of the card-handling apparatus 21. It may, therefore, be helpful to isolate some of the circuitry of the control system from the rest of the machine. In one embodiment of the present invention, a number of optically coupled isolators are used to act as a barrier to electrostatic discharge.

Figure 17:
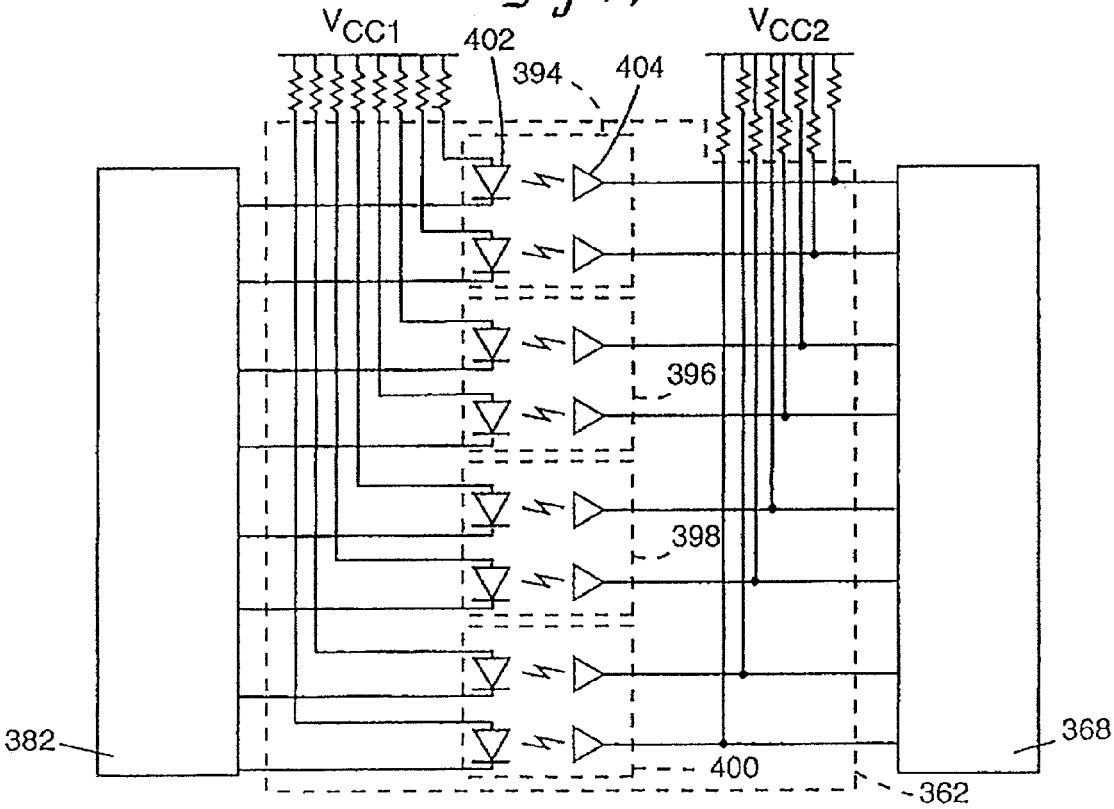
FIG. 17 is a detailed schematic diagram of a portion of FIG. 16.

As shown in FIG. 16, a first group of circuitry 390 can be electrically isolated from a second group of circuitry 392 by using optically coupled logic gates that have light-emitting diodes to optically (rather than electrically) transmit a digital signal, and photo detectors to receive the optically transmitted data. An illustration of electrical isolation through the use of optically coupled logic gates is shown in FIG. 17, which shows a portion of FIG. 16 in detail. Four Hewlett-Packard HCPL-2630 optocouplers (labeled 394, 396, 398 and 400) are used to provide an 8-bit isolated data path to the outputs 368. Each bit of data is represented by both an LED 402 and a photo detector 404. The LEDs 402 emit light when forward biased, and the photo detectors 404 detect the presence or absence of the light. Data is thus transmitted without an electrical connection.

Second Card-Moving Mechanism

Figure 8A:
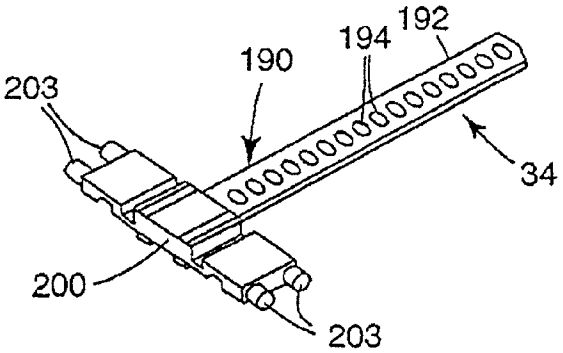
FIG. 8A is a perspective view of the pusher assembly of the present invention.
Figure 8:
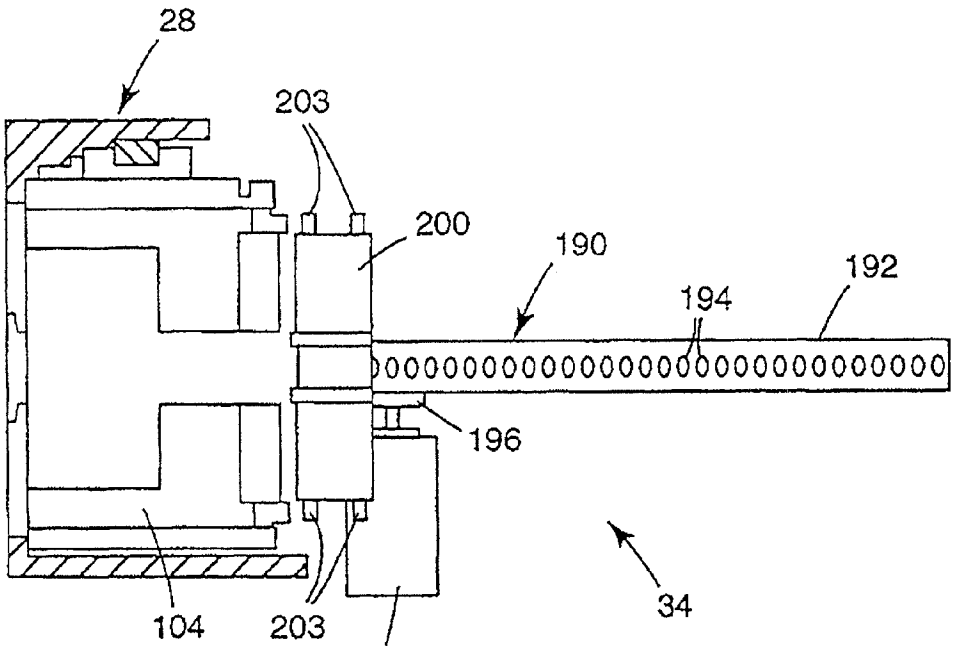
FIG. 8 is a top plan view of one embodiment of a pusher assembly of the present invention.

Referring to FIGS. 4, 8 and 8A, the apparatus 21 includes a second card-moving mechanism 34 comprising a reciprocating card-unloading pusher 190. The card-unloading pusher 190 includes a substantially flexible pusher arm 192 in the form of a rack having a plurality of linearly arranged apertures 194 along its length. The pusher arm 192 is operably engaged with the teeth of a pinion gear 196 driven by an unloading motor 198 controlled by the microprocessor. At its leading or card-contacting end, the pusher arm 192 includes a blunt, enlarged card-contacting head end portion 200. The head end portion 200 is greater in height than the spacing between the shelf members 104 forming the compartments 106 to make sure that all the cards contained in a compartment 106 are contacted and pushed as it is operated, even bowed or warped cards, and includes a pair of outstanding guide tabs 203 at each side of the head end portion 200 for interacting with the second card receiver 36 for helping to ensure that the cards are moved properly and without jamming from the compartments 106 to the second card receiver 36. The second card-moving mechanism 34 is operated periodically (upon demand) to empty stacks of cards from compartments 106, i.e., compartments 106 that have received a complement of cards or a selectable minimum number of cards.

Second Card Receiver

When actuated, the second card-moving mechanism 34 empties a compartment 106 by pushing cards therein into a second card receiver 36, which may take the form of a shoe-like receiver, of the apparatus 21. The second card receiver 36 is shown in FIGS. 1, 4, 12 and 13, among others.

Figure 13:
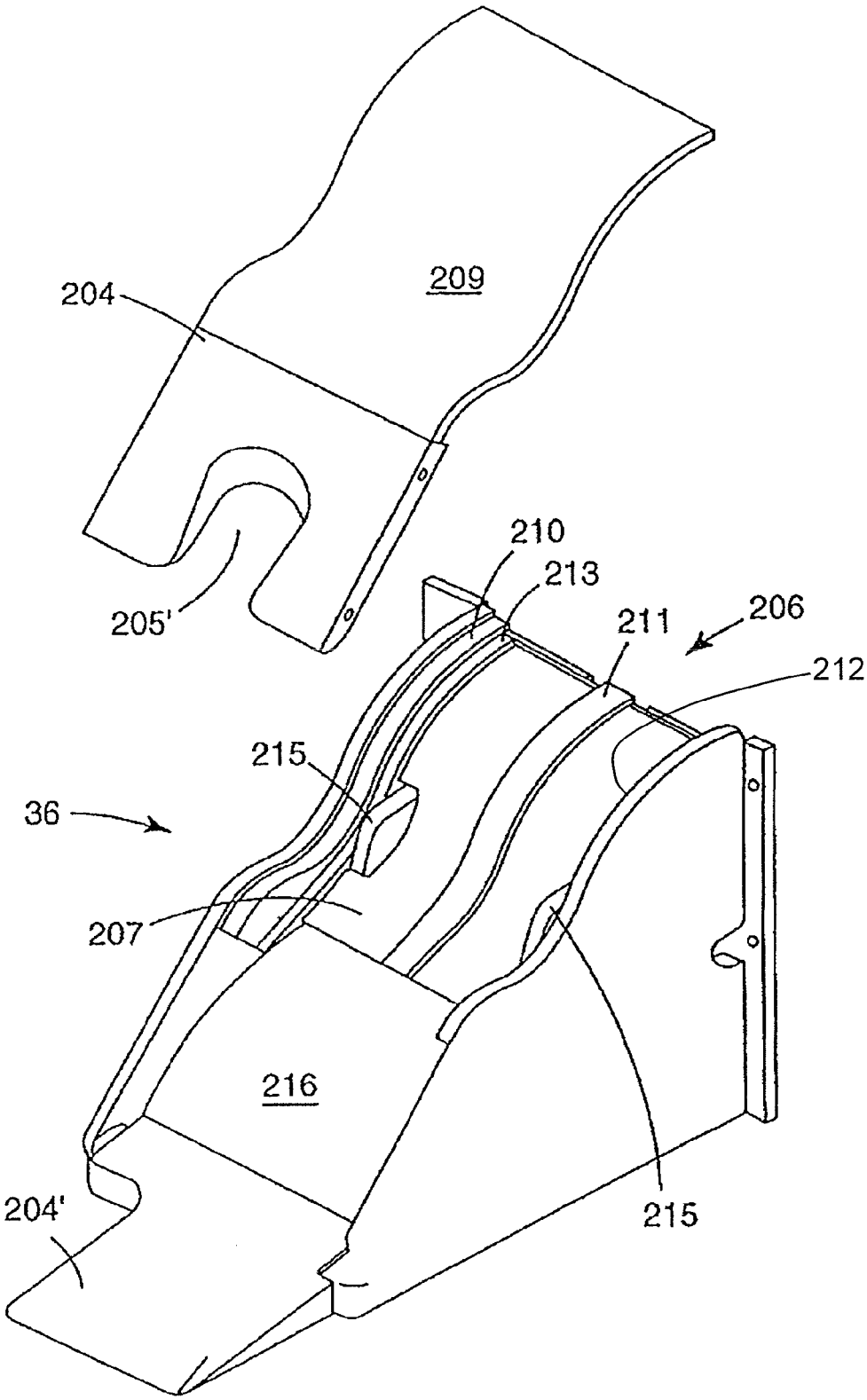
FIG. 13 is a perspective view of a portion of the card-handling apparatus of the present invention, namely, a second card receiver at the front of the apparatus, with a cover portion of the shroud removed.

Referring to FIGS. 12 and 13, the second card receiver 36 includes a shoe-like terminal end plate 204 and a card way, indicated generally at 206, extending generally between the rack assembly 28 and the terminal end plate 204. When a compartment 106 is aligned with the card way 206, as shown in FIG. 12, the card way 206 may be thought of as continuous with the aligned compartment 106. Referring to FIG. 4, an optional cover-operating motor 208 is positioned generally under the card way 206 for raising and lowering a removable cover 142 if such a cover is used.

Referring back to FIGS. 4, 12 and 13, the card way 206 has a double-curved, generally S-shaped surface and comprises a pair of parallel card-guiding rails 210, 212, each having one end adjacent to the rack assembly 28 and a second end adjacent to the terminal end plate 204. Each card-guiding rail 210, 212 has a card-receiving groove 213. An S-shaped card support 211 is positioned between the card-guiding rails 210, 212 for supporting the central portion of a card or group of cards as it moves down the card way 206. A pair of card-biasing springs 215 are provided adjacent to the rails 210, 212 to urge the cards upwardly against the top of the grooves 213 to assist in keeping the all the cards in the group being moved into the second card receiver 36 in contact with the pusher 190. The curves of the card way 206 help to guide and position cards for delivery between cards already delivered and a card-pushing block 214, which is generally similar to the block 68. A second curved portion 207, in particular, helps position and align the cards for delivery between cards already delivered and the card-pushing block 214.

The second card receiver 36 is generally hollow, defining a cavity for receiving cards and for containing the mirror image rails 210, 212, the cover-operating motor 208 and the freely movable card-pushing block 214. Referring to FIG. 12, the card-pushing block 214 has an angled, front card-contacting face 216, the angle of which is generally complementary to the angle of the terminal end plate 204. The card-pushing block 214 has a wheel or roller 218 for contacting a sloping or angled floor 220 of the second card receiver 36 whereby the card-pushing block 214 moves freely back and forth. The free movement helps absorb or accommodate the force generated by the dealer's hand as he deals, i.e., the card-pushing block 214 is free to bounce rearwardly. A suitable bounce limit means (such as a stop 221 mounted on the floor 220, or a resilient member, not shown) may be coupled near the card-pushing block 214 to limit the rearward travel of the card-pushing block 214. Referring to FIG. 4, a suitable receiver empty sensor 222 may be carried by the terminal end plate 204 at a suitable location, and a card jammed sensor 224 may be provided along the card way 206 adjacent to the guide rails 210, 212. The receiver empty sensor 222 is for sensing the presence or absence of cards. The receiver empty sensor 222 senses the location of card-pushing block 214 indicating the number of cards in the second card receiver 36, and may be operably linked to the microprocessor or directly to the unloading motor 198 for triggering the microprocessor to actuate the pusher 190 of the second card-moving mechanism 34 to unload one or more groups of cards from the compartments 106.

As depicted in FIG. 13, the terminal end plate 204 may include a sloped surface 204'. The sloped surface 204' has a raised portion closest to the terminal end plate 204, and that portion fits generally under a notch 205' in the terminal end plate 204 for receiving a dealer's finger to facilitate dealing and to help preserve the flatness of the cards. The sloped surface 204', the terminal end plate 204 and a removable card way cover 209 may be formed as a unit, or as separable individual pieces for facilitating access to the inside of the second card receiver 36.

FIG. 12 is a largely representational view depicting the apparatus 21 and the relationship of its components, including the card receiver 26 for receiving a group of new or played cards for being shuffled for play, including the well 60 and block 68, the rack assembly 28 and its single stack of card-receiving compartments 106, the card-moving or card-transporting mechanism 30 between and linking the card receiver 26 and the rack assembly 28, the card unloading pusher 190 for emptying the compartments 106 and the second receiver 36 for receiving randomized or shuffled cards.

Operation/Use

Appendix B outlines one embodiment of the operational steps or flow of the method and apparatus of the present invention. The start input is actuated and the apparatus 21 homes (see Appendix B). In use, played or new cards to be shuffled or reshuffled are loaded into the well 60 by moving the block 68 generally rearwardly or removing it. Cards are placed into the well 60 generally sideways, with the plane of the cards generally vertical, on one of the long side edges of the cards (see FIGS. 5 and 12). The block 68 is released or replaced to urge the cards into an angular position generally corresponding to the angle of the angled card-contacting front face 70 of the block 68, and into contact with the pick-up roller assembly 150. As the cards are picked up (i.e., after the separation of a card from the remainder of the group of cards in the well 60 is started), a card is accelerated by the speed-up system 160 and spit or moved through a horizontal opening between stop plates 180, 182 and into a selected compartment 106. Substantially simultaneously, movement of subsequent cards is underway, with the rack assembly 28 position relative to the cards being delivered by the card-transporting mechanism 30 being selected and timed by the microprocessor, whereby selected cards are delivered randomly to selected compartments 106 until the cards in the well 60 are exhausted. In the unlikely event of a card jam during operation (for example, if one of the sensors is blocked or if the card-unloading pusher 190 hits or lodges against the rack assembly 28), the apparatus 21 may flow automatically or upon demand to a recovery routine, which might include reversal of one or more motors, such as the pick-off or speed-up motors 504, 507, and/or repositioning of the rack assembly 28 a small distance up or down.

Upon demand from the receiver empty sensor 222, the microprocessor randomly selects the compartment 106 to be unloaded, and energizes the unloading motor 198, which causes the pusher 190 to unload the cards in one compartment 106 into the second card receiver 36. The card unloading pusher 190 is triggered by the receiver empty sensor 222 associated with the second receiver 36. It should be appreciated that each cycle or operational sequence of the card-handling apparatus 21 transfers all of the cards placed in the well 60 each time, even if there are still cards in some compartments 106. In one embodiment, the apparatus 21 is programmed to substantially constantly maintain a "buffer" (see FIG. 12, wherein the buffer is depicted at "B") of a selected number of cards, for example, 20 cards, in the second card receiver 36. A buffer "B" of more or fewer cards may be selected.

In operation, when card present sensor 74 detects cards present, the entire stack of unshuffled cards in the card receiver 26 is delivered one by one to the card-receiving compartments 106. A random number generator is utilized to select the compartment 106 that will receive each individual card. The microprocessor is programmed to skip compartments 106 that hold the maximum number of cards allowed by the program. At any time during the distribution sequence, the microprocessor can be instructed to activate the unloading sequence. All compartments 106 are randomly selected.

It is to be understood that, because cards are being fed into and removed from the apparatus 21 on a fairly continuous basis, the number of cards delivered into each compartment 106 will vary.

Preferably, the microprocessor is programmed to randomly select the compartment 106 to be unloaded when more cards are needed. Most preferably, the microprocessor is programmed to skip compartments 106 having seven or fewer cards to maintain reasonable shuffling speed.

It has been demonstrated that the apparatus of the present invention provides a recurrence rate of at least 4.3%, a significant improvement over known devices.

In one exemplary embodiment, the continuous card-handling apparatus 21 of the present invention may have the following specifications or attributes that may be taken into account when creating an operational program.

Machine Parameters—Four-Deck Model:

1. Number of compartments 106: variable between 13-19;
2. Maximum number of cards/compartment: variable between 10-14;
3. Initial number of cards in second card receiver 36: 20-24;
4. Theoretical capacity of the compartments 106: 147-266 cards (derived from the number of compartments 106× the preferred maximum number of cards/compartment 106);
5. Number of cards in the second card receiver 36 to trigger unloading of a compartment 106: variable between 6-10; and
6. Delivery of cards from a compartment 106 is not tied to a predetermined number of cards in a compartment 106 (e.g., a compartment 106 does not have to contain 14 cards to be unloaded). The minimum number of cards to be unloaded may range from between 4 to 7 cards and it is preferred that no compartment 106 be completely full (i.e., unable to receive additional cards) at any time.

In use, it is preferred that the apparatus 21 incorporates features, likely associated with the microprocessor, for monitoring and recording the number of cards in each group of cards being moved into the second card receiver 36, the number of groups of cards moved, and the total number of cards moved.

In one embodiment, taking into account the apparatus attributes set forth above, the apparatus 21 may follow the following sequence of operations:

Filling the machine with cards:

1. The dealer loads the well 60 with pre-shuffled cards;
2. Upon actuation, the apparatus 21 randomly loads the compartments 106 with cards from the well 60, one card at a time, picking cards from the top of the cards in the well 60;
3. When one of the compartments 106 receives a predetermined number of cards, unload that compartment 106 into the second card receiver 36;
4. Continue with #2. No compartment 106 loading during second card receiver 36 loading;
5. When a second compartment 106 receives a predetermined number of cards, unload that compartment 106 into the second card receiver 36, behind cards already delivered to the second card receiver 36;
6. The dealer continues to load cards in the well 60 that are randomly placed into the compartments 106; and
7. Repeat this process until the initial number of cards in second card receiver 36 has been delivered.

In another practice of the present invention, there are three or more (or fewer) separate methods of filling the shoe. The method may be preferably randomly selected each time the machine is loaded. Step 3 (above) outlines one method. A second method is described as follows: Prior to the beginning of the filling cycle, a distinct number of compartments (e.g., four compartments) are randomly selected, and as those compartments reach a minimum plurality number of cards (e.g., six cards), those compartments unload as they are filled to at least that minimum number. The second method delays the initial loading of the shoe as compared to the first method. In a third method, as cards are loaded into the rack assembly, no cards unload until there are only a predetermined plurality number (e.g., four) of compartments remaining with a maximum number (e.g., six or fewer) of cards. When this condition is met, the shoe loads from the last plurality number (e.g., four) of compartments as each compartment is filled with a minimum number (e.g., six cards) of cards. This third method delays loading even more as compared to the first and second methods.

Continuous Operation

1. The dealer begins dealing;
2. When the number of cards in the second card receiver 36 goes down to a predetermined number sensed by receiver empty sensor 222, unload one group of cards from one of the compartments 106 (randomly selected);
3. As cards are collected from the table, the dealer loads cards into the well 60. These cards are then randomly loaded into compartments 106. In case a compartment 106 has received the maximum number of cards allowed by the program, if selected to receive another card, the program will skip that compartment 106 and randomly select another compartment 106; and
4. Repeat #2 and #3 as play continues. It is preferable that the ratio of cards out of or in play to the total number of cards available should be low, for example, approximately 24:208.

Another concern in continuous shufflers is the fact that there has been no ability to provide strong security evaluation in the continuous shufflers, because of the very fact that the cards are continuously being reshuffled, with cards present within and without the shuffler. This offers an increased risk of cards being added to the deck by players or being removed and held back by players. This is a particular concern in games where players are allowed to contact or pick up cards during play (e.g., in certain poker-type games and certain formats for blackjack). The present invention provides a particular system wherein the total number of cards in play at the table may be verified with minimum game interruption. This system may be effected by a number of different procedures, each of which is exemplary and is not intended to limit the options or alternatives that may be used to effect the same or similar results.

One method of effecting this system comprises a continuous counting, analysis, and reporting based on at least some (but not necessarily all) of the following information provided to the microprocessor: the total initial number of cards provided to the shuffler, the number of cards dealt to each player, the number of cards dealt in a complete game, the number of cards dealt in a round, the total number of cards dealt out since new cards were introduced, the total number of cards returned to the shuffler, the difference between the number of cards dealt out and the number of cards returned to the shuffler, specific cards removed and re-supplied to the shuffler, and the like. It must be noted that continuous shufflers are intended to run with no total replacement of the cards to be shuffled, except when the used decks are replaced with new decks. As opposed to the more common batch shufflers (where a specific number of decks are shuffled, the shuffled decks are cut, the game is played with cards distributed until the cut is reached, and then the decks are reinserted into the shuffler for shuffling), the continuous shuffler maintains a large stock of cards within the shuffler assembly, with cards used in the play of a hand being reinserted into the assembly to be combined with the stock of cards that are shuffled and added to the shoe for distribution to the players. This creates a card distribution pattern where the cards are ordinarily distributed between various sections of a shuffler (e.g., a feeder, a separation rack, a shoe, etc.), a manually stored portion of cards on the table, including, for example, excess cards, discards, cards used in part or in whole in the play of the hand, and cards held by a player. This pattern makes it very difficult to maintain surveillance of the cards and maintain security with respect to the number or type of cards present on the table.

One type of continuous shuffler that is particularly useful in the practice of the present invention comprises a shuffler with a feeder zone, separation or shuffling zone (or "rack," depending upon the design) and shoe zone. This shuffling zone could be any type of shuffling zone or shuffling process, including those constructions known in the art, wherein the novel feature of keeping a card count of cards specifically within a specific zone within the system is maintained. This is opposed to a construction where cards are merely counted in a batch as they are initially fed into a machine or into a zone. In this practice, for example, a constant count of cards is maintained in the shuffling zone by counting the cards inserted, the cards removed, and additional cards inserted into the zone. The feeder zone is a section where cards are inserted into the shuffling apparatus, usually stacked in a collection of cards to be shuffled. The feeder zone is a storage area in the shuffling device that stores unshuffled cards and provides or feeds those cards into a shuffling function. The shuffling or separation zone is a region within the shuffling or card-handling apparatus where unshuffled cards are randomly distributed or separated into compartments or receiving areas to form subsets of randomly distributed cards from the unshuffled cards provided from the feeder zone. The shuffling zone could be any region within the device that accomplishes randomization of the cards while keeping track of the actual number of cards within the zone. The shoe is the section of the shuffling apparatus where shuffled cards are stored for delivery to a) players, b) the dealer and/or to c) discard or excess piles. The shoe may receive limited numbers of cards that are replenished (usually automatically) from the separation area. The general operation of this type of system would be as follows, with various exemplary, but non-limiting, options provided.

Cards are inserted into the feeder region of the shuffler. A number of cards are fed, usually one at a time, into the shuffling or separation zone (hereinafter referred to as the "shuffling zone"). The number of cards may be all of the cards (e.g., 1, 2, 3, 4, 5 or more decks, depending upon the size of the apparatus and its capacity) or less than all of the cards. The microprocessor (or a networked computer) keeps track of the number of cards fed from the feeder zone into the shuffling zone. The shuffling zone may comprise, for example, a number of racks, vertical slots, vertical compartments, elevator slots, carousel slots, carousel compartments, or slots in another type of movable compartment (movable with respect to the feeding mechanism from the feeder, which could include a stationary separation department and a movable feeder).

The shuffling zone can also include a completely different style of randomization or shuffling process, such as the shuffling processes shown in Sines et al., U.S. Pat. Nos. 5,676,372 and 5,584,483. Although the described apparatus is a batch-type shuffler, the device could be easily modified to deliver cards continuously, with a resupply of spent cards. The device, for example, could be adapted so that whenever discards are placed in the infeed tray, the cards are automatically fed into the shuffling chamber. The programming could be modified to eject hands, cards or decks on demand, rather than only shuffling multiple decks of cards.

In that type of apparatus, a stack of cards is placed up on edge in the shuffling zone, with one group of card edges facing upwardly, and the opposite edges supported by a horizontal surface defining a portion of the shuffling chamber. The stack of cards is supported on both sides, so that the group of cards is positioned substantially vertically on edge.

A plurality of ejectors drive selected cards out of the stack by striking an edge of a card, sending the card through a passage and into a shuffled card container. Shuffling is accomplished in one shuffling step. In this example, by equipping the shuffler with a feed mechanism that is capable of counting each card that is loaded, including the cards added into the stack during operation, and counting each card ejected from the stack, it is possible to keep track of the total number of cards within the shuffling zone at any given time.

In another example of the present invention, the shuffling chamber may be similar to that shown in U.S. Pat. No. 4,586,712 to Lorber et al. That device shows a carousel-type shuffling chamber having a plurality of radially disposed slots, each slot adapted to receive a single card. A microprocessor keeps track of the number of empty slots during operation (see column 7, lines 5-16).

In the example of a slot-type shuffling apparatus that accepts more than one card per shelf or slot, the cards are generally inserted into the particular type of compartments or slots available within the system on a random basis, one card at a time. This creates a series of segments or sub-sets of cards that have been randomly inserted into the compartments or slots. These sub-sets are stored until they are fed into the shoe. The number of cards delivered from the shuffling zone into the shoe are also counted. In this manner, a constant count of the number of cards in the shuffling zone is maintained. At various times, either random times or at set intervals or at the command of the microprocessor, cards from the separation zone are directed into the shoe. The microprocessor may signal the need for cards in the shoe by counting the number of cards removed from the shoe (this includes counting the number of cards inserted into the shoe and the number of cards removed from the shoe), so that a count of cards in the shoe may be maintained.

The process may then operate as follows. At all times (continually), the microprocessor tracks the number of cards present in the shuffling zone. The dealer or other floor personnel activates the card verification process, halting the delivery of cards from the shuffling zone to the shoe. All cards on the table are then fed into the shuffling zone. The total cards in the shuffling zone (e.g., within the rack of compartments or slots) is determined. If there are cards in the shoe zone, those cards in the shoe are placed into the feeder zone. The cards are fed from the feeder zone into the shuffling zone. The total of cards 1) originally in the shuffling zone area and 2) the cards added to the feeder (and any cards already in the feeder that had not been sent to the shuffling zone before discontinuance of the handling distribution functions of the apparatus) and then fed into the separation zone are totaled. That total is then compared to the original number or programmed number of cards in the system. A comparison identifies whether all cards remain within the system or whether security has been violated.

The system may indicate a secure system (e.g., the correct amount or number of cards) by a visual signal (e.g., LED or liquid crystal readout, light bulb, flag, etc.) or audio signal. Similarly, an insecure security condition (e.g., insufficient number of cards or plethora of cards) could be indicated by a different visual or audio signal, or could activate an unloading sequence. If an insecure system notice is produced, there may be an optional function of reopening the system, recounting the cards, pausing and requiring an additional command prior to unloading, allowing the dealer to add additional cards subsequently found (e.g., retained at a player's position or in a discard pile), and then recounting some or all of the cards.

Alternatively, the cards in the shoe may also be accurately accounted for by the microprocessor. That is, the microprocessor in the card-handling device of the present invention may count the cards in the shuffling zone and the cards in the shoe zone. This would necessitate that sensing be performed in at least two locations (from the feeder into the shuffling zone and out of the shoe) or more preferably in at least three locations (from the feeder to the shuffling zone, from the shuffling zone to the shoe zone, and cards removed from the shoe). Therefore, the cards may be counted in at least three different ways within the apparatus and provide the functionality of maintaining a count of at least some of the cards secure within the system (that is, they cannot be removed from the system either without the assistance of the dealer, without triggering an unlock function within the system, or without visually observable activity that would be observed by players, the dealer, house security, or video observation).

For example, by counting and maintaining a count only within the shuffling zone, there is no direct access to the counted cards except by opening the device. By counting and maintaining a count within only the shuffling zone and the shoe, there is no direct access to the shuffling zone, and the cards may be removed from the shoe only by the dealer, and the dealer would be under the observation of the players, other casino workers, and video camera observation.

The initiation of the count will cause a minor pause in the game, but takes much less time then a shuffling operation, including both a manual shuffling operation (e.g., up to five minutes with a six-deck shoe) and a mechanical shuffling operation (one to four minutes with a one- to six-deck shoe, which is usually performed during the play of the game with other decks), with the counting taking one minute or less. The actual initiation of the count must be done by the dealer or other authorized personnel (e.g., within the house crew), although the card-handling apparatus may provide a warning (based on time since the last count, the time of day, randomly, on a response to instructions sent from a house's control center, or with other programmed base) that a count should be performed. The count may be initiated in a number of ways, depending upon where the count is being performed. A starting point would always be providing an initial total card count of all cards to be used with the shuffler. This can be done by the machine actually counting all the cards at the beginning of the game, by the dealer specifically entering a number for the total number of cards from a keypad, or by indicating a specific game that is defined by the number of cards used in the game. The card verification process is preferably repeated automatically whenever a card access point is opened (i.e., a shoe cover or door is opened).

As an example, a situation will be analyzed where the dealer decides that a count is to be made in the system where card count is maintained in the shuffling zone only. The dealer enters or presets a specific card count of 208 (two hundred eight cards, four decks) into the microprocessor for the shuffler by pressing numbers on a keypad. The dealer will deactivate any function of the machine that takes cards out of the shuffling zone. All cards on the table and in the shoe will then be added to the feeder zone. The cards will be automatically fed from the feeder zone into the shuffling zone and, as a security function, each counted as it passes from the feeder zone to the shuffling zone. The count from this security function (or card totaling of cards not stored in the shuffling zone) will be added by the microprocessor to the running or rolling shuffling zone card count to provide a total card count. This total card count will then be compared to the preset value.

In another embodiment, a four-deck game of SPANISH 21® blackjack will be played. The dealer indicates the game to be played, and the card-handling device (shuffler) indicates that 192 (one hundred ninety-two, that is, 4×48) cards will be used. After one hour, the shuffler indicates that a count is required for security. The apparatus counts all cards in the shuffling zone and the shoe. The dealer closes a panel over the shoe to restrict access to the cards. The players' cards from the last hand, any discards, and all other cards not in the shuffling zone or shoe are then added to the feeder zone. The cards in the feeder zone are then fed into the shuffling zone and counted as the new card entry total. That new card entry total is added to the rolling total for cards held within the combined shuffling zone and shoe. If the total is 192, a green light (or other color, or LED or liquid crystal display, or audio signal) will indicate that the proper count was achieved. If the count is inaccurate, a number of different procedures may be activated after the card-handling device has appropriately indicated that there is a discrepancy between the original or initial card count and the final card count performed on command by the device. If the card count reveals an insufficiency (e.g., fewer than 192 cards), the device may pause and the dealer and/or other casino employees will visually examine the table to see if cards were inadvertently left out of the count. The shuffler may also have the capability to abort a shuffling procedure and require a reloading of cards. If cards are found, the additional cards will be added to the feeder zone, an additional count initiated, and that second count total added to the initial final card count total. If the total still lacks correspondence to the initial count, a further search may be made or security called to investigate the absence of cards. If the device is in a "pause" mode, the dealer may activate an unloading process or a recounting process. A complete separate count may be made again by the machine and/or by hand to confirm the deficiency. The indication of an excess of cards is a more definitive initial indication of a security issue. After such an indication, security would be called (either by floor personnel or by direct signal from the microprocessor) and an immediate count (mechanical and/or manual) of all the cards would be made. That issue would be resolved by the recount indicating the correct number of cards or indicating that an excess of cards actually exists.

The device can be constructed with not only a sensor or sensors to count the cards, but also with a scanner or scanners that can read data on the cards to indicate actual card ranks and values. In this manner, particularly by reading the cards going into the shoe and being removed from the shoe, and/or reading the cards going into distinct compartments within the rack, the shuffler may monitor the actual cards within the apparatus, not merely the number of cards present. In this manner, as where a jackpot is awarded and the cards must be verified, the card-handling device may quickly verify the presence of all cards by value and rank within the decks. This can also be used to verify a hand by identifying which cards are specifically absent from the total of the cards originally inserted into the gaming apparatus. For example, the player's hand with a jackpot-winning hand is left in front of the player. The apparatus is activated to count and identify cards. If the apparatus indicates that A-K-Q-J-10 of Hearts are missing from the count and the player has the A-K-Q-J-10 of Hearts in front of her/him, then the jackpot hand is verified with respect to the security of the total of the playing cards. This is ordinarily done manually and consumes a significant amount of time.

The system of the present invention, in addition to allowing a security check on the number of cards present in the collection of decks, allows additional cards, such as promotional cards or bonus cards, to be added to the regular playing cards, the total number of cards allowable in play modified to the number of regular playing cards plus additional (e.g., special) playing cards, allowing the shuffler to be modified for a special deck or deck(s) where there are fewer than normal cards (e.g., SPANISH 21® blackjack), or otherwise modified at the direction of the house. Therefore, the shuffler would not be limited to counting security for only direct multiples of conventional 52-card playing decks. The shuffler may be provided with specific selection features wherein a game may be identified to the microprocessor and the appropriate number of cards for that game shall become the default security count for the game selected.

Figure 18:
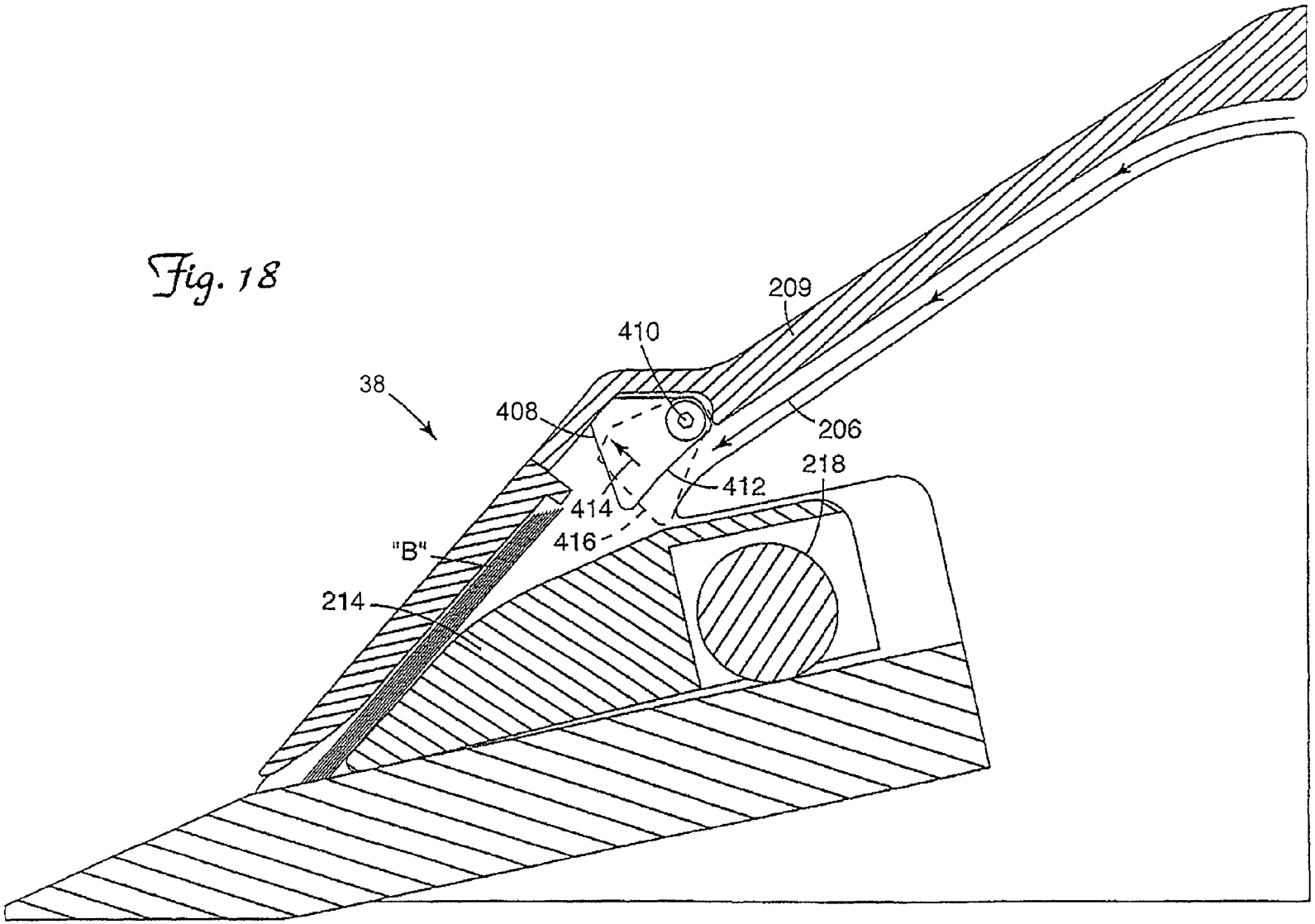
FIG. 18 is a side cross-sectional view of a device that prevents a dealer from pushing cards in an output shoe back into a card way.

The present invention also describes a structural improvement in the output shoe cover to prevent cards that are already within the shoe from interfering with the delivery of additional cards to the shoe. FIG. 18 is a side cross-sectional view of an output shoe 38 incorporating a gate 408 mounted for pivotal movement about an axis 410. The gate 408 is of sufficient size and shape to retract and avoid obstruction of card way 206 when cards are moving into output shoe 38. A leading edge of a group of cards (not shown) contacts a first surface 412, moving gate 408 upwardly and substantially in a direction shown by arrow 414.

Once the group of cards passes into the output shoe 38, as shown by the position of the group of cards identified as "B", the gate 408 lowers by means of gravity to a second position shown in phantom at 416, blocking an opening to card way 206. With gate 408 in the lower resting position shown at 416, the dealer cannot inadvertently push cards "B" back into the card way 206 when removing cards "B" from the output shoe 38. In this manner, the card way 206 is always capable of passing another group of cards to the output shoe 38, assuring a continuous supply of cards.

Figure 19:
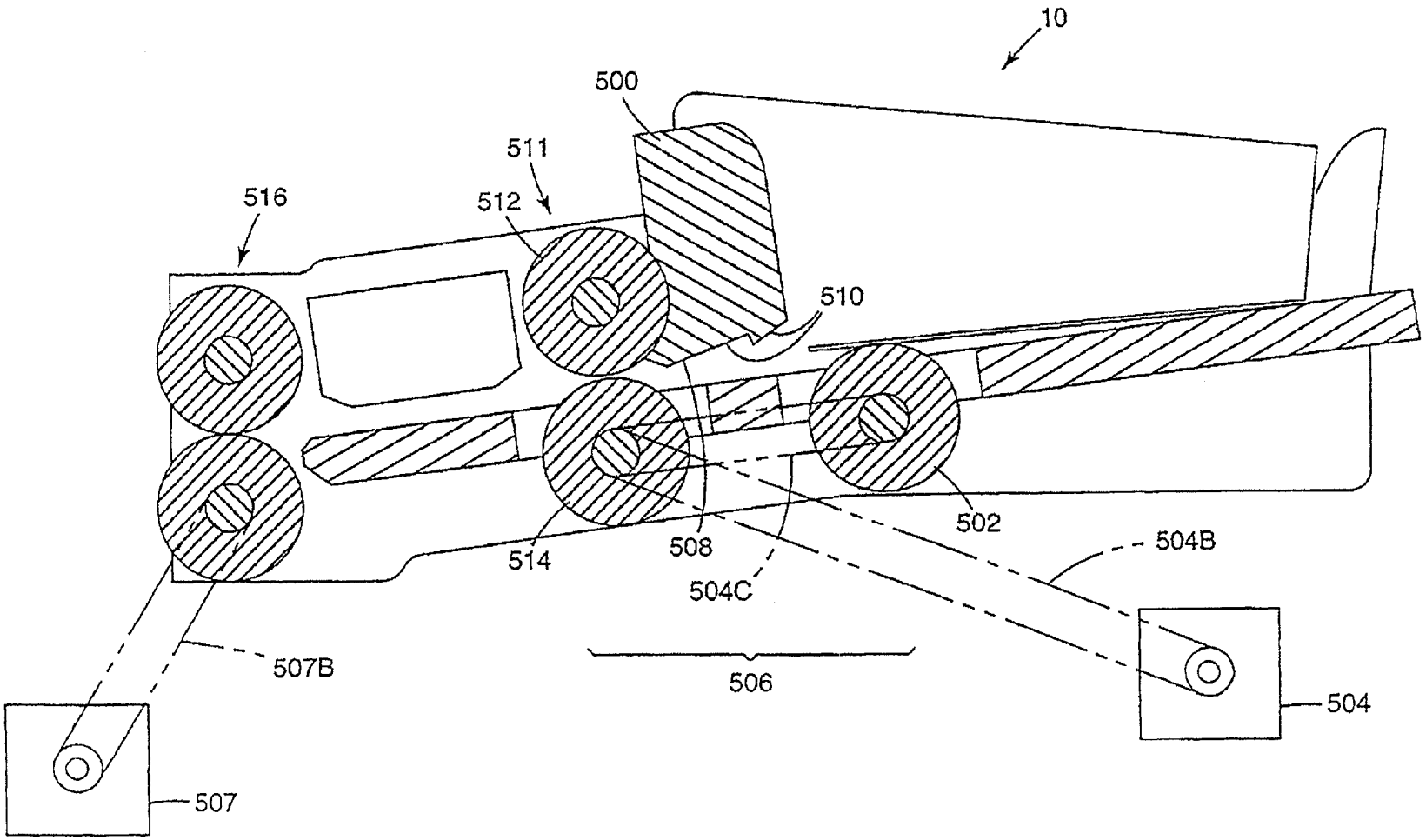
FIG. 19 is a side view of a new feeder system with a novel design for a card separator that has the potential for reducing jamming and reducing the potential for multiple card feed when a single card is to be fed.

A novel gravity feed/diverter system is described to reduce the potential for jamming, and to greatly reduce the chance for multiple cards being fed into the shuffling zone. In this feature, two separate features are present between the feeder zone and the separation zone, as shown in FIG. 19, which is a side view of a new feeder system with a novel design for a card separator that has the potential for reducing jamming and reducing the potential for multiple card feed when a single card is to be fed. The two features shown are adjacent to a feed tray 10. The feed tray 10 is angled (at other than horizontal) with respect to the horizontal plane, but could also be substantially horizontal. The cards are urged towards the features on a discriminating barrier 500 by a pick-off roller 502. The pick-off roller 502 is shown here as driven by a motor 504. The shape of a lower edge 508 of the discriminating barrier 500 is important because it discourages more than one card at a time from passing from the feed tray 10 to a separation zone 506. In the event that two cards are accidentally moved at the same time, the discriminating barrier 500, because of the height of the lower edge 508, will allow only one card to pass through, with the second (usually topmost) card striking a braking surface 510 within the discriminating barrier 500 and retarding its forward movement.

The braking surfaces 510 are shown as two separate surfaces. However, the braking surface 510 can be a single continuous surface or more than two surfaces. It is important that a contact surface be provided that inhibits forward movement of a card resting upon another card. Since the friction between the two adjacent cards is minimal, the contact surface does not need to include sharply angled or substantially vertical surfaces to inhibit the forward movement of the card.

Another aspect of the separator of the present invention is the presence of a brake roller assembly 511. The brake roller assembly 511 includes a stationary top roller 512 and a driven roller 514. The spacing between top roller 512 and driven roller 514 is selected so that only one card can pass through the discriminating barrier 500. Single cards passing through brake roller assembly 511 pass through speed-up roller assembly 516, and into the shuffling zone.

Upon failing to advance, the apparatus may be programmed to treat the presence of the additional card (sensed by sensing elements within the shuffler, not shown) as a jam or as the next card to be advanced, without an additional card removed from the feeder zone. Separating the cards to assure that only one card at a time is fed is critical to obtaining accurate card counting and verification (unless the counting system is sufficiently advanced to enable distinguishing between the number of cards fed and counting that number of cards).

Other features and advantages of the present invention will become more fully apparent and understood with reference to the following specification and to the appended drawings and claims.

APPENDIX A

| Motors, Switches and Sensors | | |
|---|---|---|
| Item | Name | Description |
| 1 | ICPS | Input Card Present Sensor |
| 2 | RCPS | Rack Card Present Sensor |
| 3 | RHS | Rack Home Switch |
| 4 | RPS | Rack Position Sensor |
| 5 | UHS | Unloader Home Switch |
| 6 | DPS | Door Present Switch |
| 7 | RUTS | Rack Unload Trigger Sensor |
| 8 | CIS | Card In Sensor |
| 9 | COS | Card Out Sensor |
| 10 | GUS | Gate Up Switch |
| 11 | GDS | Gate Down Switch |
| 12 | SWRTS | Shoe Weight Release Trigger Sensor |
| 13 | SES | Shoe Empty Sensor |
| 14 | SJS | Shoe Jam Sensor |
| 15 | SS | Start Switch |

| Name | Description |
|---|---|
| POM | Pick-off Motor |
| SUM | Speed-up Motor |
| RM | Rack Motor |
| UM | Unloader Motor |
| SWM | Shoe Weight Motor |
| GM | Gate Motor |
| SSV | Scroll Switch - Vertical |
| SSH | Scroll Switch - Horizontal |
| AL | Alarm Light |

Display: Noritake * CU20025ECPB-U1J

Power Supply: Shindengen * ZB241R8, ZB241R7K2, or ZB241R7 or EOS Corporation ZVC45FS24E or Qualtek Electric 862-06/002 or Delta 06AR1

Linear Guide: THK * RSR12ZMUU+145 M, or 2RSR12Z MUU+229I M

Comm. Port: Digi * HR021-ND

Power Switch: Digi * SW 323-ND

Power Entry: Bergquist * LT-101-3P

APPENDIX B

| Homing/Power-up | |
|---|---|
| 1. | Unloader Home |
| 2. | Door Present |
| 3. | Gate Closed |
| 4. | Card Out Sensor (COS) Clear |
| 5. | Rack Empty and Home |
| 6. | Input Shoe Empty |
| 7. | Output Shoe Empty |
| 8. | Card In Sensor (CIS) Clear |
| 9. | Shoe Jam Sensor Clear |

Figure 20:
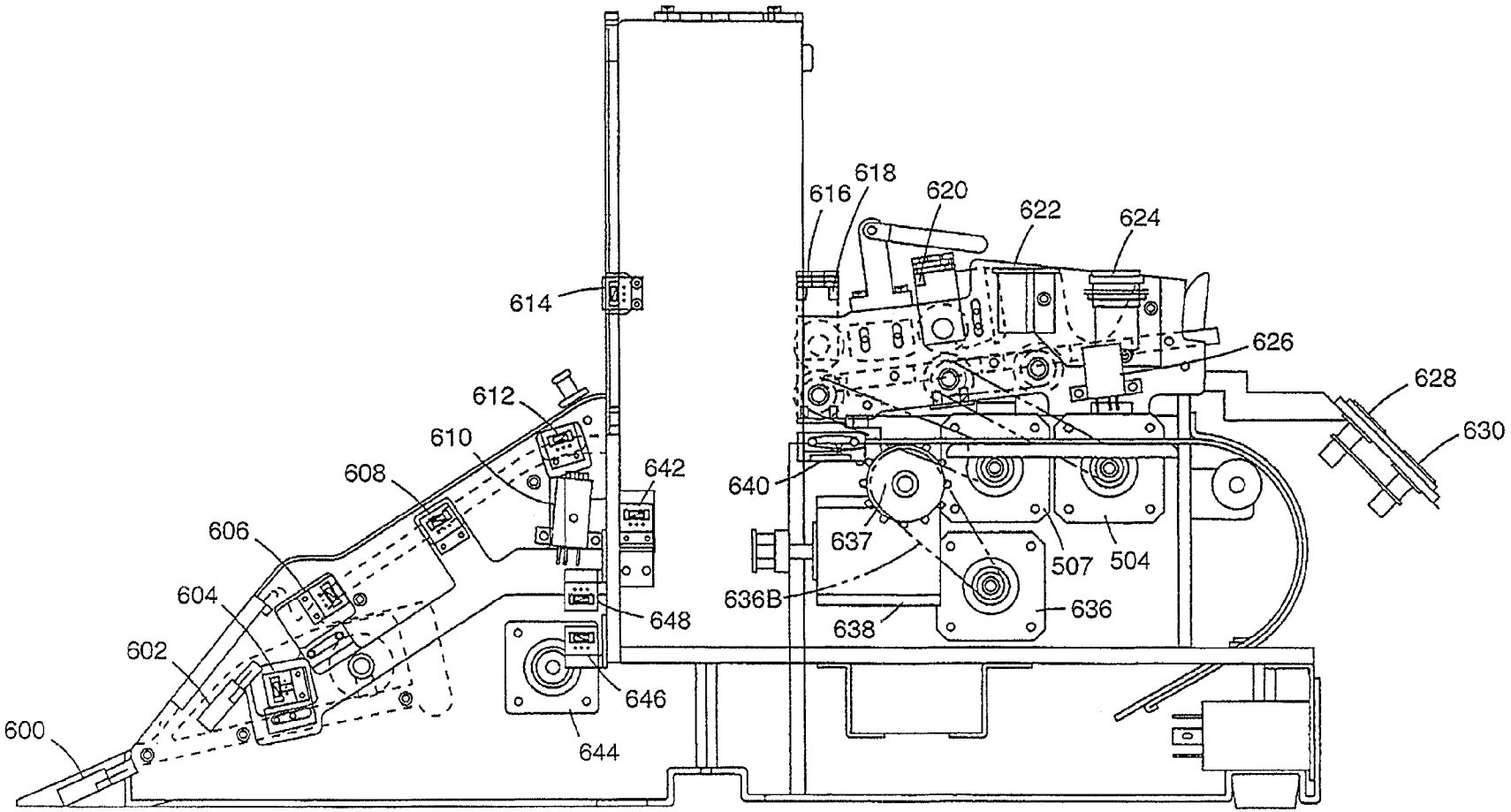
FIG. 20 shows a side cutaway view of a shuffler of the present disclosure, emphasizing locations, sensors and motors.

An extremely desirable feature of the shuffler of the present invention is the system of monitoring and moving cards. FIG. 20 identifies the sensor and motor locations for a preferred embodiment of the invention.

Representative sensors are optical sensors with a light emitter and receiver. An example of a suitable sensor is a model number EE-SPY401, available from Omron of Schaumburg, Ill. The space constraints and the specific function of each sensor described below are factors to be considered when selecting a sensor. Although optical sensors are described below, it is possible to use other types of sensors, such as proximity sensors, pressure sensors, readers for information installed on the cards (e.g., magnetic readers), and the like.

Sensor 600 is the dealing sensor. This sensor 600 is capable of generating a signal for every card removed from the shoe. The signals are sent to the microprocessor, and are used to determine when the dealer removes the cards.

Sensor 602 is the shoe empty sensor. This sensor 602 generates a signal when no cards are present in the shoe. The sensor 602 generates a signal that is sent to the microprocessor. This signal is interpreted by the microprocessor as an instruction to deliver another group of cards to the shoe. This sensor 602 is a backup sensor, because the shoe is normally not empty. The sensor 602 is used primarily to verify that the shoe is empty when the machine is initially loaded with cards.

Unloader trigger sensor 604 senses the amount of cards in the shoe, and generates a signal when a predetermined minimum number of cards are present in the shoe. The signal is sent to the microprocessor, and the microprocessor interprets the signal as an instruction to unload and deliver another group of cards into the shoe. In one example, the unloader trigger sensor 604 activates a random number generator. The random number generator randomly selects a number between zero and three. The selected number corresponds to the number of additional cards to be dealt out of the shoe prior to unloading the next group of cards. If the randomly selected number is zero, the unloader immediately unloads the next group of cards.

Unloader extended switch 606 generates a signal that is indicative of the position of the unloader. When the unloader is in the extended position, unloader extended switch 606 generates a signal that is received by the microprocessor. The microprocessor interprets the signal as instructions to halt forward movement of the unloader, and to reverse movement.

Staging switch 608 senses the position of the unloader. The staging switch 608 is positioned at a point along the card way 206 (FIG. 4). As a group of cards reaches the staging switch 608, the staging switch 608 sends a signal to the microprocessor to stop forward movement of the unloader. A group of cards is therefore staged in the card way 206. The microprocessor also receives signals from sensor 600 so that the staged group of cards is released while the dealer is removing cards from the shoe. This assures that the cards in the shoe, if pushed backwards initially, are traveling toward or resting against the exit of the shoe during unloading. In another example of the invention, the staging switch 608 unloads only when a signal from sensor 600 is interrupted.

Rack emptying sensor 610 indicates when a rack has been unloaded. The rack emptying sensor 610 is functional only when the shoe cover is open. The rack emptying sensor 610 functions during a process of emptying cards from the machine. The microprocessor interprets the signal as instructions to initiate the emptying or unloading of a rack. When the signal is interrupted, the microprocessor instructs the rack to align another compartment with the unloader.

Shoe cover switch 612 indicates the presence of the shoe cover. When the signal is interrupted, the microprocessor halts further shuffling. When the signal is reestablished, normal shuffling functions resume upon reactivating the machine.

Door present switch 614 senses the presence of the door covering the opening to the racks. When the signal is interrupted, the microprocessor halts further shuffling. When the signal is reestablished, normal shuffling functions resume upon reactivating the machine.

Card out sensor 616 indicates when a card is passing into the rack from the speed-up rollers 516 (FIG. 19). The microprocessor must receive the signal in order to continue to randomly select a compartment or shelf and instruct elevator motor 638 to move the elevator to the next randomly selected position. If the signal is interrupted, the microprocessor initiates a jam-recovery routine. To recover from a card jam, the elevator is moved up and down a short distance. This motion almost always results in a trailing edge of the jammed card making contact with the speed-up rollers 516. The speed-up rollers 516 then deliver the card into the compartment. If the recovery is unsuccessful, the signal will remain interrupted and operations will halt. An error signal will be generated and displayed, and instructions for manually unjamming the machine will preferably be displayed. The function of the card out sensor 616 is also critical to the card counting and verification procedure described above, as the signal produces a count of cards in each shelf in the rack.

Card in sensor 618 is located on an infeed end of the speed-up rollers 516 and is used both to monitor normal operation and to provide information to the microprocessor useful in recovering from a card feed jam. During normal operation, the microprocessor interprets the generation of the signal from card in sensor 618, the interruption of that signal, the generation and interruption of card out sensor 616, in sequence as a condition of counting that card. If a card were to travel in the reverse direction, that card would not be counted. During the jam-recovery process, the interruption of the signal from card in sensor 618 tells the microprocessor that a jam occurring in the speed-up rollers 516 has been cleared.

Card separator empty sensor 620 monitors the progression of the cards as the cards leave the brake roller assembly 511 (FIG. 19). Although there is another card present sensor, feeder empty sensor 626, as will be described below in the input shoe 10, card separator empty sensor 620 senses the presence of the card before the signal generated by feeder empty sensor 626 is interrupted. Because the spacing between sensors 620, 626 is less than a card length, the information sent to the microprocessor from both sensors 620, 626 provides an indication of normal card movement.

Switch 622 is the main power switch. Upon activating the switch 622, a signal is sent to the microprocessor to activate the shuffling process. In one embodiment of the invention, upon delivering power to the shuffler, a test circuit first tests the voltage and phase of the power supply. A power adapter (not shown) is provided, and the available power is converted to a DC power supply for use by the shuffler.

Light 624 is an alarm light. The microprocessor activates the alarm light 624 whenever a fault condition exists. For example, if the cover that closes off the mixing stack or the shoe cover is not in place, the alarm light 624 would be illuminated. If the card verification procedure is activated, and an incorrect number of cards is counted, this would also cause alarm light 624 to illuminate. Other faults, such as misdeals, card feed jams, card insertion jams, card delivery jams, and the like, are all possible triggering events for the activation of alarm light 624.

Feeder empty sensor 626 is an optical sensor located on a lower surface of the card-receiving well 60 (FIG. 5). Feeder empty sensor 626 sends a signal to the microprocessor. The microprocessor interprets the signal as an indication that cards are present, and that the feed system is to be activated. When the signal is interrupted, indicating that no cards are in the well 60, the feed roller 502 (FIG. 19) stops delivering cards. In one embodiment, the lower driven roller 514 of brake roller assembly 511 runs continuously, while in the embodiment shown in FIG. 19, the driven roller 514 runs only when feed roller 502 runs. Similarly, speed-up rollers 516 can run continuously or only when the feed roller 502 and driven roller 514 are being driven. In one example, the operation of rollers 514 and 502 is intermittent, while the operation of speed-up rollers 516 is continuous.

Referring back to FIG. 20, enter key 628 and scroll key 630 are both operator input keys. The enter key 628 is used to access a menu, and to scroll down to a particular entry. The scroll key 630 permits the selection of a field to modify, and enter key 628 can be used to input or modify the data. Examples of data to be selected and or manipulated include: the type of game being played, the number of decks in the game, the number of cards in the deck, the number of promotional cards, the total number of cards in the machine, the table number, the pit number, and any other data necessary to accomplish card verification. Enter key 628 provides a means of selecting from a menu of preprogrammed options, such as the type of game to be played (such as blackjack, baccarat, pontoon, etc.), the number of cards in the deck, the number of promotional cards, the number of decks, etc. The menu could also include other information of interest to the house, such as the date, the shift, the name of the dealer, etc. This information can be tracked and stored by the microprocessor in associated memory, and included in management reports, or in other communications to the house.

A number of motors are used to drive the various rollers in the feed assembly (shown in FIG. 19). Feed roller 502 is driven by motor 504, via continuous resilient belt members 504B and 504C. Driven roller 514 is also driven by motor 504 via continuous resilient belt member 504B. In another embodiment, rollers 502 and 514 are driven by different motors. Speed-up roller assembly 516 is driven by motor 507, via resilient belt member 507B. Each of the motors is typically a stepper motor. An example of a typical stepper motor used for this application is available from Superior Electric of Bristol, Conn. by ordering part number M041-47103.

Motor 636 drives the card unloading pusher 190 via continuous resilient member 636B. The resilient member 636B turns pulley or pinion gear 637, causing lateral motion of unloader 190. Teeth of pinion gear 637 mesh with apertures 194 in card unloading pusher 190 (see FIG. 8).

Rack motor 638 causes the rack assembly to translate along a linear path. This path is preferably substantially vertical. However, the rack could be positioned horizontally or at an angle with respect to the horizontal. For example, it might be desirable to position the rack so that it travels along a horizontal path to reduce the overall height of the device. The shaft of rack motor 638 includes a pulley that contacts timing belt 82 (FIG. 12). Timing belt 82 is fixedly mounted to the rack assembly.

Unloader home switch 640 provides a signal to the microprocessor indicating that the unloader 190 is in the home position. The microprocessor uses this information to halt the rearward movement of the card unloading pusher 190 and allow the card unloading pusher 190 to cease motion.

Rack home switch 642 provides a signal to the microprocessor that the rack is in the lowermost, or "home," position. The home position, in a preferred embodiment, causes the feed assembly to come into approximate vertical alignment with a top shelf or opening of the rack. In another embodiment, the home position is not the lowermost position of the rack.

Gate motor 644 drives the opening and closing of the gate. Gate down switch 646 provides a signal to the microprocessor indicating that the gate is in its lowermost position. Gate up switch 648 provides a signal that the gate is in its uppermost position. This information is used by the microprocessor to determine whether the shuffling process should proceed, or should be stopped. The microprocessor also controls the gate via gate motor 644 so that the gate is opened prior to unloading a group of cards.

In a preferred device of the present invention, the number of cards in the rack assembly is monitored at all times while the shuffler is in the dealing mode. The microprocessor monitors the cards fed into and out of the rack assembly, and provides a visual warning that the number or amount of cards in the rack assembly is below a critical (predetermined, preset) number or level. When such a card count warning is issued, the microprocessor stops delivering cards to the shoe. When the cards are fed back into the machine and the number of cards in the rack assembly rises to an acceptable (preset or predetermined) level, the microprocessor resumes unloading cards into the shoe. The number of cards is dependent upon the game being dealt and the number of players present or allowed. For example, in a multi-deck blackjack game using 208 cards (four decks), the minimum number of cards in the rack is approximately 178. At this point, a signal is sent to the visual display. When the number of cards drops to 158 (the preset number), the microprocessor will stop delivery of cards to the shoe. Limiting the number of cards outside the rack assembly maintains the integrity of the random shuffling process. Although a description of preferred embodiments has been presented, various changes, including those mentioned above, could be made without deviating from the spirit of the present invention. It is desired, therefore, that reference be made to the appended claims rather than to the foregoing description to indicate the scope of the invention.

What is claimed is:

1. A card-handling device, comprising:

a card-holding area;

a card output shoe, the card output shoe comprising:

a base member;

a terminal end plate;

a card block movable along a surface of the base member;

a card-way for passage of cards from the card-holding area into a dealing-ready area defined by an interior surface of the terminal end plate and a surface of the card block;

a movable gate positioned between the card-way and the dealing-ready area to prevent cards in the dealing-ready area from re-entering the card-way, the movable gate pivotally mounted in the card output shoe.

2. The card-handling device of claim 1, wherein the card-handling device comprises a card shuffler.

3. The card-handling device of claim 1, wherein the card-holding area comprises a card infeed area.

4. The card-handling device of claim 1, wherein the card-holding area comprises a plurality of card-holding compartments.

5. The card-handling device of claim 1, wherein the card output shoe further comprises a movable card-way cover, and wherein the movable gate is pivotally mounted to the movable card-way cover.

6. The card-handling device of claim 1, wherein the movable gate is mounted to block an exit end of the card-way from passage of cards when the movable gate is in a first resting position, and to allow passage of cards from the exit end of the card-way when the movable gate is in a second retracted position.

7. The card-handling device of claim 1, wherein the base member comprises a downwardly sloping upper surface and wherein the movable card block is movable along the downwardly sloping upper surface.

8. The card-handling device of claim 1, wherein the terminal end plate comprises an inverted U-shaped opening for manual removal of cards.

9. A method of moving cards through a card-handling device, comprising:

inserting cards into a card-holding area of the card-handling device;

moving cards from the card-holding area through a card-way into a dealing-ready position of the card-handling device, the dealing-ready position defined by an area between an inner surface of a terminal end plate and a front surface of a card block movable along a downwardly sloping support surface, card movement through the card-way to the dealing-ready position allowed by a movable gate pivotally mounted in the card handling device and card movement from the dealing-ready position into the card-way prevented by the movable gate; and manually removing cards from the card-handling device by contacting the cards through an inverted U-shaped opening in the terminal end plate.

10. The method of claim 9, wherein moving cards from the card-holding area through a card-way comprises moving the cards from the card-holding area through the card-way with a mechanical card-moving system.

11. The method of claim 9, further comprising holding cards in the dealing-ready position against the terminal end plate with the card block.

12. The method of claim 9, further comprising pivoting the movable gate relative to the terminal end plate to allow the cards to move from the card-way into the dealing-ready position, wherein the movable gate is proximate a terminal end of the card-way.

13. The method of claim 12, wherein pivoting the movable gate comprises pivoting the movable gate from a first position blocking an opening of the card-way to a second position not blocking an opening to the card-way.

14. The method of claim 13, wherein pivoting the movable gate comprises contacting the movable gate with cards passing through the card-way to cause the movable gate to pivot from the first position to the second position to allow cards to pass into the dealing-ready position.

15. A card shuffler, comprising:

card-receiving compartments, each card-receiving compartment for holding a randomized group of cards therein;

a card output shoe comprising a terminal end plate; and a gate mounted to allow movement of the randomized groups of cards from the card-receiving compartments to proximate the terminal end plate of the card output shoe and mounted to block movement of cards in an opposite direction in a first position responsive to gravity.

16. The card shuffler of claim 15, wherein the gate is movable from the first position blocking movement of cards to a second position allowing movement of the randomized groups of cards from the card-receiving compartments to proximate the terminal end plate.

17. The card shuffler of claim 15, wherein the gate is pivotally mounted to the card output shoe.

18. The card shuffler of claim 15, further comprising:

a movable card block proximate the terminal end plate against which cards to be removed from the card output shoe rest; and a sensor coupled to the movable card block for sensing a position of the movable card block to sense a presence of cards between the movable card block and the terminal end plate.

19. A card shuffler, comprising:

card-receiving compartments, each card-receiving compartment for holding a randomized group of cards therein;

a card output shoe comprising a terminal end plate;

a gate mounted to allow movement of the randomized groups of cards from the card-receiving compartments to proximate the terminal end plate of the card output shoe and mounted to block movement of cards in an opposite direction;

a movable card block proximate the terminal end plate against which cards to be removed from the card output shoe rest; and a sensor coupled to the movable card block for sensing a position of the movable card block to sense a presence of cards between the movable card block and the terminal end plate.

* * * * *